US009468837B2

(12) United States Patent
Ramirez

(10) Patent No.: US 9,468,837 B2
(45) Date of Patent: Oct. 18, 2016

(54) GOLF GLOVES

(71) Applicant: John C. Ramirez, Redlands, CA (US)

(72) Inventor: John C. Ramirez, Redlands, CA (US)

( * ) Notice: Subject to any disclaimer, the term of this patent is extended or adjusted under 35 U.S.C. 154(b) by 322 days.

(21) Appl. No.: 14/092,970

(22) Filed: Nov. 28, 2013

(65) Prior Publication Data

US 2015/0143607 A1 May 28, 2015

(51) Int. Cl.
*A63B 57/00* (2015.01)
*A63B 71/14* (2006.01)
*A41D 19/015* (2006.01)

(52) U.S. Cl.
CPC ..... *A63B 71/146* (2013.01); *A41D 19/01547* (2013.01); *A63B 57/207* (2015.10); *A63B 57/353* (2015.10); *A63B 2209/00* (2013.01); *A63B 2209/08* (2013.01)

(58) Field of Classification Search
CPC ..... A63B 71/14; A63B 71/146
USPC ..... 2/16, 161.2, 158–160, 161.1, 161.3, 2/161.5, 161.6, 161.8, 163, 164, 907
See application file for complete search history.

(56) References Cited

U.S. PATENT DOCUMENTS

| | | | | |
|---|---|---|---|---|
| 4,131,952 | A * | 1/1979 | Brenning, Jr. | 2/16 |
| 4,665,565 | A * | 5/1987 | Odom | 2/161.2 |
| 6,427,248 | B1 * | 8/2002 | Albert | 2/161.3 |
| 6,553,575 | B1 * | 4/2003 | Davenport et al. | 2/161.2 |
| 2003/0208833 | A1 * | 11/2003 | Gold | 2/161.1 |
| 2008/0120754 | A1 * | 5/2008 | Raymond | 2/16 |
| 2010/0077526 | A1 * | 4/2010 | Smeltzer | 2/16 |
| 2013/0191961 | A1 * | 8/2013 | Litke | 2/161.2 |

* cited by examiner

*Primary Examiner* — Khaled Annis

(57) ABSTRACT

A glove for enhancing a wearer's grip and control of a golf club or sports device. The glove may include a palmar portion and a dorsal portion having multiple digital segments that entirely enclose each of a wearer's five digital segments. The dorsal segment may include a high friction surface only along the forefinger digital segment or middle finger digital segment, or both.

7 Claims, 16 Drawing Sheets

The interlocking grip (RELATED ART)

GOLF GLOVES

FIELD OF THE INVENTION

The present invention relates to sports apparatus and equipment, and uses thereof, used in playing the game of various sports. The present invention and its glove embodiments enhance the overall performance in athletic tasks and/or execution commonly associated during sports play, particularly in, but not limited to golf by configuring to meet the specific requirements of a user who plays the sport of golf. The present invention unique configurations generally enclose the thumb as well as the forefinger, middle, ring and pinkie fingers of a user's hand, including the fingertips. Furthermore, these gloves comprise a grip enhancing means on the dorsal portion of the glove, on the side or sides of any digital segments, or any combination thereof. Embodiments may also provide a grip enhancing means along select segments of the palmar portion, including but not limited to, along the thumb segment's palmar portion.

BACKGROUND OF THE INVENTION

An important goal in playing sports is to win. Often that means proper play execution, good ball control, good grip and feel, and proper form in the sports fundamentals. Gloves and other types of hand covers are permitted in most sports. Many individuals use gloves to enhance, in some way, their competitive edge. Indeed, gloves have become so important that different types of gloves have been uniquely created for different sports. Even within a sport, different types of gloves have been invented to, among other things, maximize performance in specific tasks.

The use of gloves can increase performance especially when the user needs to grip an object like a golf club, for example.

When playing the sport of Golf this ability to create and maintain a solid grip is critical when swinging a golf club especially since, when one prepares to swing the golf club, he (or she) must use his hands both to grip as well as 'feel' the golf club throughout the golf swing.

This ability to both grip and feel is important when swinging a golf club. Once a golfer begins to swing a golf club, the golfer cannot not lose sight of the golf ball until impact occurs with the golf ball. Consequently, the golfer must use tactile sensations to feel if the golf club is on the correct swing plane throughout the golf swing.

The use of gloves in golf however is critical as most golf pros will agree, the most important factor in a good golf swing is the ability to have a solid grip on the golf club; a good golf grip. It's the fundamental keystone to a good golf swing.

Thus, golfers have generally decided to wear only one glove, on their weak hand, thereby increasing the overall grip of the weak hand golf glove and thus foregoing a glove on their strong (dominant) hand to compensate for the loss of tactile sensation from wearing a glove on their weak-hand.

Conventional golf gloves are generally full fingered leather gloves, many with a grip enhancing surface on the palmar portion of these gloves. Some of these gloves also provide elastic inserts along the knuckles for added flexibility or micro recesses along the finger segments of the dorsal portion of these gloves.

Although generally useful, using prior art conventional golf gloves can come with significant drawbacks, especially because a user must use his or her hands as one cohesive unit throughout a golf swing.

Several authorities have cited the importance of the golfer's two hands forming a cohesive structural unit along the golf club, so they can function as a single club-gripping agent. This is so important that the two most popular golf grip methods, the interlocking grip method and the overlapping grip method, place the hands right next to each other to better create this unitary hand golf swing.

As will be discussed, prior art gloves are not configured to support this desire to unify the golfer's two hands, and many gloves actually hinder achieving this objective.

A case in point of prior art limitations occurs, for example, when a golfer desires to swing the golf club with significant velocity.

Quite often a golfer's success requires swinging the golf club in a manner to produce significant club speed, especially when teeing off at the beginning of each hole. As the velocity of the golf club increases, it becomes increasingly more difficult to maintain a firm, though not tight, grip on the club; this is especially true on the downswing through the point of impact with the golf ball. Consider the fact that the average clubhead speed of all eight competitors in the 2013 RE/MAX Golf World Long Drive Competition was well over 100 miles per hour; these golfers especially rely on a good grip to control the golf club so that the club face will be square at impact with the golf ball.

Prior art shortcomings create a challenge to have a consistent swing, especially when swinging a golf club at these high speeds. Clearly, one reason for this has to do with not sustaining the ability to keep one's hands together throughout the golf swing, especially when transitioning from the backswing to the downswing, as well as at—and through—impact with the golf ball. The result, of course, has often resulted in several problems such as: difficulty in weak-hand and dominant hand coordination because one hand unhinges quicker than the other hand; difficulty in being able to control the golf club face through impact, and; the dominant hand's pinkie finger slipping from contacting the weak hand. As a consequence, the golf club face may not be square at impact, resulting in a slice or hook.

Another prior art limitation relates to those golfers choosing to grip a golf club using the popular Interlocked Grip Method.

When one uses this grip the forefinger of the golfer's gloved weak hand is placed over and wrapped around the strong hand's ungloved pinkie finger.

With this grip, clearly the role of the interlocked fingers have as much to do with grip as they do with coordination between the user's two hands to more effectively control the golf swing and to provide greater overall golf swing consistency.

A golfer's ungloved strong hand has improved tactile sensations by the rest of the fingers being placed on the golf club. Additionally, these ungloved fingers can still grip the golf club relatively well due to the grip enhancers along the golf club handle itself.

However, no improvements have been made to increase the grip of the strong hand's interlocked or overlapped pinkie finger, which is ungloved, a vital ingredient to maximizing overall hand coordination and golf swing.

An additional major drawback of prior art has to do with a lack of grip enhancers where the ungloved pinkie finger resides around the gloved forefinger. The dorsal segment is not currently configured with this in mind, often actually providing a rather slippery dorsal segment, making it more difficult for the ungloved hand to grip and better coordinate with the gloved weak hand throughout the golf swing.

Embodiments of the present invention will certainly find success with those using the interlocking grip method as well by properly configuring gloves to address this issue.

According to the website Golfsmith.com, many golfers choose the interlocking grip instead of the overlapping grip method: because they desire greater unity in their golf swing, because they have relatively smaller hands, or because they have weaker hands and need added grip. Thus, providing even greater overall grip potential for those using the interlocking grip method, as the present invention provides, would certainly be welcome. "A common reason players choose one grip over another is their desire to create unity between their hands. When you swing your club, your wrists act as a hinge. However, if your hands become separated during the swing, each wrist can act separately and your hands can interfere with each other."

There is therefore a long existing need for a glove that can offer better hand coordination between a golfer's strong hand and weak hand without significantly diminishing a golfer's ability to adequately grip the golf club.

An ideal location to minimize hand separation is clearly around and between the two interlocked fingers in the case of the interlocked method, or around and between the overlapped fingers, in the case of the overlapped method.

Another prior art limitation relates to those golfers choosing to grip a golf club using the popular Overlapping Grip Method.

Currently, the ungloved strong hand's pinkie finger has no real targeted, stable material where it could reasonably maintain a firm hold as a golf club moves over 100 miles per hour, through impact. Prior art dorsal segments—the back of gloves—are intended for protection and without recognition of the need for providing some added grip support.

Consequently, users with prior art golf gloves will have an unstable pinkie finger grip, especially when dealing with moisture through harsh climate or from perspiration on the pinkie finger. This slipping, even slight, can result in some separation or delay in hand motion; the results would of course be detrimental on a golfer's score card.

When a golfer hits a slice, for example, the golf ball flies to the far outside (far right for a right-handed golfer or far left for a left-handed golfer).

A slice can take place for several reasons. One reason has to do with the dominant hand not moving at the same rate and angle as the weak hand during a golf swing, or not unhinging at the same time. If there is even the slightest separation between the two hands during the golf swing, the club face will not be square at impact; the resulting open face impact will inevitably result in a slice.

Embodiments of the present invention would therefore offer significant improvements to prior art by offering strategically placed grip enhancing improvements to gloves tailored for users who grip a golf club using one's preferred golf grip method, including the overlapping golf grip method. These improvements will include a grip enhancing means along the dorsal portion or along the side of the golf glove, thereby providing a user's dominant hand pinkie finger to maintain solid grip on the weak hand; the result will of course significantly enhance a golfer's golf swing success by better allowing the two hands to have a coordinated, unified golf swing.

More broadly, providing a more strategic grip management system will create a firmer contact between the fingers of both hands, and therefore a more controlled golf swing for those using the interlocking or overlapping grip methods.

An additional glove configuration deficiency along its dorsal segment has to do the way these gloves channel moisture accumulation from the gloved hand. Most conventional golf gloves, for example, have ventilation recesses along the dorsal portion of the digital segments including on the forefinger segment, which of course can be counterproductive and problematic especially when gripping a golf club using the interlocking grip or overlapping grip methods (see FIGS. 10 and 16).

Conventional golf gloves provide recesses on the proximal phalanx of the forefinger which channel perspiration to this area, albeit small amounts. Undoubtedly this is problematic because the strong hand's ungloved pinkie finger interlocks and often resides over the weak hand's gloved forefinger's proximal phalanx. Intentionally trying to channel moisture to this interlocked area will clearly cause unnecessary slipping between the two interlocked fingers and further hinder the user's ability to perform a unified, coordinated golf swing. These prior art configurations can also cause significant challenges to those using the overlapping grip method for similar reasons.

Solving this unrecognized problem, as embodiments of the present invention provide, will significantly enhance consistent golf swing control especially as a golfer begins to perspire from wearing a golf glove. Some embodiments, for example, include a forefinger segment without any moisture management recesses along the proximal phalanx on the forefinger segment or along select portions of the middle finger segment, where the strong hand's pinkie finger usually rests on the weak hand when using the overlapping grip method, for example.

Providing a solution to better solve these issues could, among other things, allow for greater golf swing control and consistency by providing a golfer with significantly enhanced support for a golfer's hand grip and coordination requirements.

The present invention solves the above mentioned problems by, among other things, providing significant improvements to grip support on critical areas on or around the interlocked or overlapped fingers.

DETAIL DESCRIPTIONS OF THE INVENTION

The present invention provides a glove having dorsal (back) and palmar (front) portions for overlaying respective back and palm regions of a human hand, and dorsal and palmar portions having distal and proximal ends with a plurality of digital segments (or stalls) projecting from said distal ends. The digital segment of the thumb covers the thumb generally including the fingertip of said thumb of a user, the digital segment of the forefinger covers the forefinger including generally the fingertip of said forefinger of a user, the digital segment of the middle finger covers the middle finger including generally the fingertip of said middle finger of a user, the digital segment of the ring finger covers generally the ring finger including the fingertips of said ring finger of a user, and the digital segment of the pinkie finger covers the pinkie finger including generally the fingertip of said pinkie finger of a user.

An improvement of said golf gloves comprises a grip enhancing means on the dorsal portion of these gloves, on the side or sides of any existing digital segments, or any combinations thereof.

In one preferred aspect, a grip enhancing means is provided on the dorsal segment of the glove, preferably either along the forefinger segment or middle finger segment, or both, in part or in their entirety.

In another embodiment, a grip enhancing means is provided on the side of the forefinger or middle finger segment, or both, in part or in their entirety.

For example, a grip enhancing means may be provided on the dorsal portion of any existing forefinger segment, preferably generally on its proximal phalanx but extending as far as overlaying its metacarpophalangeal joint, its proximal interphalangeal joint, or both; a grip enhancing means on the side of any existing forefinger segment, adjacent to the middle finger segment; a grip enhancing means on the side of any existing forefinger segment, adjacent to the thumb segment; a grip enhancing means on the region between the middle finger segment and a user's forefinger segment, extending as far down the dorsal portion to include the forefinger and middle finger segment's metacarpophalangeal joints and the area in between said joints (but not extending beyond said joints), defining the respective boundaries of the embodiment.

A grip enhancing means may be provided on the dorsal portion of any existing middle finger segment, preferably generally on its proximal phalanx but extending as far as overlaying its metacarpophalangeal joint, its proximal interphalangeal joint, or both; a grip enhancing means on the side of any existing middle finger segment, adjacent to the forefinger segment.

Preferably, at least a portion of the forefinger or middle finger's proximal phalanx, or both, will have a grip enhancing means, thereby providing substantially enhanced grip capabilities with swinging a golf club by providing significant added grip capabilities for the pinkie finger which is ungloved.

Embodiments may also comprise a grip enhancing means on any palmar segment of the glove, including on the thumb segment, preferably along the distal phalanx of said thumb, on the forefinger's interphalangeal joint, or on the pinkie finger, extending to the pinkie's metacarpal.

Another objective is to provide improved golf gloves whereby some embodiments may be configured to meet the unique needs of those employing the interlocking grip method, while other embodiments may meet the unique needs of those employing the overlapping grip method.

Accordingly, embodiments provide a novel glove that takes into account a user's preferred golf grip, particularly the interlocking grip, for example, by allowing the interlocked and ungloved strong hand's pinkie finger to better grip the non-dominant (weak) hand thereby creating a significantly more stable, solid interlocked hands throughout a golfer's swing.

The grip enhancing means can therefore be specifically positioned to provide enhanced grip and generally a higher coefficient of friction along select areas of the dorsal, side and palmar portions of the glove. The grip enhancing means will offer a golfer multiple benefits such as increased control of a ball or device thereby enhancing performance and overall success at performing a sports task, and providing golfers with the ability to better swing a golf club with more unified hands.

Users of course may prefer any grip enhancing means combinations aforementioned.

For example, an embodiment can comprise of a grip enhancing means overlaying the entire proximal and middle phalanges of the forefinger segment, which would include—and be bounded by—the dorsal, palmar and sides of the forefinger's proximal and middle phalanges segment. This area would then include, for example, a high friction surface or a textured surface, as the grip enhancing means. The grip enhancing means could be comprised of a beaded surface pattern, for example, projecting out at least millimeter or so, and which could be integral to the glove material, preferably extending throughout the entire designated surface area, but could certainly extend out to overlay the forefinger's metacarpophalangeal joint.

Another embodiment can comprise of a grip enhancing means overlaying the entire proximal phalanx of the middle finger segment, which would include—and be bounded by—the dorsal, palmar and sides of the middle finger's proximal phalanx segment. This area would then include, for example, a high friction surface or a textured surface, as the grip enhancing means. The grip enhancing means could be comprised of a beaded surface pattern, for example, projecting out at least one millimeter or so, and which could be integral to the glove material, preferably extending throughout the entire designated surface area, but could certainly extend out to overlay the middle finger's metacarpophalangeal joint.

In at least one embodiment all of the above mentioned areas will comprise of a grip enhancing means.

In general, the grip enhancing means of the present invention may be integral to the glove, may be in the form of inserts, or may be affixed to the glove surface by, for example, forming a grip enhancing panel and applying the panel onto a portion of the glove. The grip enhancing means of an embodiment could comprise, for example, a high friction textured surface with a more narrow width and length, say about 1.5 to three centimeters. This and other embodiments may include a plurality of projections on the surface as the gripping means which is formed from, for example, one of a vinyl material, a rubber material, or a neoprene material, creating a grip enhancing panel.

The material forming the panel could then be applied to a finger segment, for example, using any standard bonding methods, such as adhesion or stitching.

The panel with the projections can preferably be provided, for example, on at least one—or only on one—phalanx of any finger segment. The projections could preferably extend out about 1/10 of a centimeter, but could range generally less or more than several centimeters.

In general, the panel may preferably be formed from an elastic material or fabric, including but not limited to, a knitted fabric, for example, LYCRA, rayon, neoprene, a rubber material, a vinyl material, or the like, but may certainly be formed from a more durable material, such as silicone. Once the grip enhancing surface on the panel has been formed, the panel may then be applied to the surface of the glove by any standard methods, such as by stitches or adhesives, for example.

The grip enhancing means can also be formed on glove embodiments by any standard method, for example, by embossing, stamping or molding a portion of the glove to create the gripping means. For example, the grip enhancing means can comprise of regular projections of say, about 300 micrometers in height, but may vary in height depending on preference. The projections may all be the same height, and may be in rows; they may be embossed elongated shapes that are interconnected, thus creating a high coefficient of friction throughout the entire palmar surface area or on select dorsal portions of the glove. Other embodiments could of course offer different heights, non-uniform heights, and have a more random pattern on the select portions forming the glove.

The grip enhancing means can also be inserted on the glove by any standard method, for example, by providing a textured fabric component of which the surface inserts are made, and securing this material to the glove by sewing this material to select areas of the glove in place of the glove material.

In general, the grip enhancing means of the present invention creates a higher coefficient of friction than the surrounding portion on the glove, and can be comprised of various grip-enhancing materials, forms, coatings, and designs, including but not limited to, foams, fabrics, PVC dots, perimeter patching designs, linear and non-linear grooves, or combinations thereof, high friction surfaces, textured surfaces, a plurality of regular or irregular projections, a plurality of regular or irregular depressions, non-slip materials and coatings, such as PVC coatings, nitrile coatings and latex coatings, and designs creating coarse surfaces, as well as pebbled or beaded surfaces, convex or concave bumps, striations, cross-hatches, convex or concave linear and non-linear lines, angled ribs, random structures, convex or concave ridges, grooves, crevices, elongated segments, and the like.

Preferably, the depths of the depressions and/or heights of projections forming the grip enhancing means would be such that the gap formed by the depressions or projections would allow for some movement of the glove surface areas thereby increasing the grip capabilities of the user. The height or depth ranges can generally begin at about 100 micrometers to several millimeters or more. The grip enhancing means may create a pattern, may be in rows or randomly placed, and may form circular and non-circular shapes, such as spherical, cylindrical or elongated. Additionally, they may be individually separated or interconnected. For example, a plurality of projections (or depressions), say PVC dots, may be embossed forming a heart shape pattern, or any other universally identifiable shape or symbol. In at least one embodiment, the projections (or depressions) themselves will each be in a form of a mini heart (instead of a simple 'dot' or line, for example) and each projection (or depressions) may be applied, by embossing for example, to form any other universally identifiable shape or symbol. These identifiable shapes and symbols will likely find market use and success because these projections (or depressions), by now being placed on the dorsal segments, will be very visible and thus can provide continual inspiration or reminder.

The grip enhancing means may further comprise a plurality of spaced apart stripes or striped projections formed from a high friction material, such as a PVC material, for example. Preferably the stripes comprise raised or projecting stripes and may be arranged to extend generally parallel to the axis of any existing finger stalls. Stripes and other forms may be uniformly spaced or spaced at varying intervals. Similarly, stripes and other forms may have varying thicknesses, heights or depths, depending on preference. The thickness ranges generally can begin at about 100 micrometers to several millimeters or more.

The grip enhancing means may further comprise a tackified material or compound. Primarily used in the sport of football, tackified materials have allowed football receivers to maintain a solid, sustainable grip during moments of duress without having to apply much pressure when gripping a football. These same tackified innovations can also provide substantial value in the sport of golf. The grip enhancing means may also, therefore comprise tackified materials or compounds including but not limited a silicone sealant or those in commercial use such as C-TACK or ARMOUR GRABTACK.

Construction of tackified glove embodiments can be accomplished by any standard methods. For example, one can apply a leather golf glove embodiment with a substantially continuous layer of silicone sealant having an average thickness of approximately 0.2 to 0.4 milliliters and bonding it to a selected portion of the glove, to provide greatly enhanced control capabilities. Another common method is to apply a solvent containing a hydrocarbon resin (tackifier) and an isobutylene butane copolymer to infuse the glove material with the solvent.

The present invention may be tackified along any portion of the selected locations aforementioned, including but not limited to any portion dorsal segment or the palmar portion of the thumb segment.

It will be apparent to one of ordinary skill in the art that many other implementations of projections, depressions, grip enhancing coatings, and tackifiers are possible.

The grip enhancing means should preferably provide an effective coefficient of friction, preferably of a Shore A Durometer of about 1.5 or greater.

Accordingly, embodiments provide a novel glove with added grip-enhancing features that enhance overall control and sports performance.

Embodiments may also offer a liner which may be integrally formed on the glove. For example, the liner (or sleeve) could be attached to the glove by standard methods, such as by conventional stitching about the perimeter of the dorsal segment.

The lining material (or sleeve) may be comprised of standard lining materials, such as a smooth, flexible knitted fabric. The liner may also comprise of flexible and elastomeric material such as spandex or LYCRA. Other possible materials include a knit of polyester or simply the same material forming the glove. A soft cellular plastic could also be preferred. Additionally, the liner may provide added features to offer warmth and comfort such as by comprising of a fleece material, for example, especially useful when competing or practicing in colder conditions or when playing at night, which is beginning to gain in popularity. Liners may also provide support against chapped hands by providing a liner infused with aloe vera, as can be standard in non-sport gloves.

It will be apparent to one of ordinary skill in the art that many other implementations of liners are possible.

In yet another aspect, some embodiments may also comprise an aperture along the middle finger digital segment of the glove. The aperture will generally leave uncovered at least a portion of the middle finger segment's proximal phalanx. The aperture resides generally along the proximal phalanx, thereby defining its general boundaries. Within this parameter the location of the aperture (e.g., only on the side of the proximal phalanx or primarily on the top dorsal portion) along the middle finger segment will vary due to user preference and sport being played. These embodiments, coupled with the improvements described herein, will also offer an additional significant feature to greatly enhance golf swing performance and hand swing coordination.

The aperture on the middle finger segment could be located to leave uncovered about the top half of the proximal phalanx, for example, thus creating one rather large aperture. This finger configuration will allow a golfer to increase their overall control of a golf swing.

When the golfer uses the interlocking grip method, for example, and places the pinkie finger of his/her dominant hand around and between the covered forefinger and middle finger of his weak-hand, the coordination from the added feel between the two hands will be enhanced with this embodiment. As the strong hand's pinkie finger wraps around and embraces the weak hand's covered forefinger's proximal phalanx, the pinkie finger would abut and touch the skin of the weak hand's middle finger because of the embodiment's aperture along the middle finger segment. The pinkie finger's distal phalanx, or the fingertips, would however have increased grip capabilities by the present invention. Providing projections in the form of ridges, for example, on the dorsal segment of the interlocked forefinger's proximal phalanx, would provide the pinkie finger's fingertip with the ability to better maintain a solid, stable grip throughout a golf swing.

Accordingly, embodiments can also provide a novel glove with features that can simultaneously assist a golfer improve hand coordination by allowing the skin of the weak hand's middle finger to touch the skin of the strong hand's pinkie finger, while increasing grip on and around the interlocked fingers was well. Those using the overlapping grip method could find similar benefits by these features.

Among the benefits of this unique configuration include heightened critical tactile sensitivities to more properly feel if there is any separation between the weak hand's middle finger and the dominant hand's pinkie finger, throughout the golf swing. In addition, these embodiments should also diminish concern for those golfers who eschew the interlocking grip method because it seems uncomfortable or awkward to them.

Embodiments may also have an expandable opening means at a wrist end adapted to receive the user's hand. This may comprise of a wrist portion with a securement opening means, such as but not limited to a flap which mechanically engages a flap capture mechanism to secure the glove to the users hand (e.g., a synthetic hook and loop fastening interface which adheres when pressed together, commonly using VELCRO). In this case the flap could overlay a small slit or opening along a portion of the back of the glove to allow the glove to widen when a user places the glove onto the hand. The opening means may comprise of other standard used mechanisms of allowing a user to apply and disengage the glove, including but not limited to an elastic band material along the wrist portion, or combinations therebetween.

For example, the wrist portion can be stitched on the glove and be made of an expandable composition whereby the glove expands when being placed on a hand, and then naturally readjusts to fit snugly around the user's wrists.

This and other embodiments may also provide a detachable ball marker, such a circular magnetic disc that attaches to a magnet located on the dorsal surface area of the golf glove, for example. The ball marker may be secured by any standard fastening means, such as by magnetism or snap fastening, for example. The back portion of the detachable ball marker as well as the connecting dorsal segment of the glove may both therefore have small magnets. The ball marker may be circular or non-circular in design. Providing a detachable ball marker will make it easier for golfers to mark their golf ball on the golf green.

Embodiments may also comprise of micro-recesses along any portions of the glove, generally used on golf gloves and baseball gloves for ventilation or moisture management purposes. These micro recesses are generally about 0.120 millimeters or so in diameter. The present invention's micro recesses are generally not along the proximal phalanx of the middle finger segment or the proximal phalanx of the forefinger segment, although some embodiments may be configured as such to meet user conventional preferences. Alternatively or additionally, recesses may reside on the glove portion overlaying one or more metacarpophalangeal joints. In at least one embodiment, an aperture will reside on a metacarpophalangeal joint segment, such as along the middle finger metacarpophalangeal joint, to provide added ventilation and added flexibility. The aperture on the metacarpophalangeal joint portions will preferably not extend beyond said joint portions, thereby defining their terminal edges.

At least one embodiment will provide micro-recesses along the side of the middle finger segment, preferably along it's proximal phalanx adjacent the ring finger segment, or along the side of the forefinger segment, preferably along it's proximal phalanx, adjacent the thumb, so as to direct moisture away from the interlocked fingers.

Providing a more strategic moisture management system configured for users of the interlocking grip method or the overlapping grip method will add to dryer connected hands and therefore more successful golf swings.

The finger segments of embodiments are preferably designed to fit snugly around a user's fingers, as are typical sports gloves. In addition, some embodiments may have material treated by a moisture repellant, for example SCOTCH GUARD or a synthetic resin, extremely useful during harsher weather conditions. Additionally, embodiments may also comprise various weather-resistant and perspirant-resistant materials, forms and designs including, but not limited to, water-resistant materials or micro-recess designs along any portion of the glove, for moisture management, or combinations thereof.

Embodiments may be made and manufactured using standard materials and methods in developing sports gloves. Materials that can comprise these glove embodiments include, but are not limited to, woven materials such as natural, synthetic or blends of natural and synthetic yarns, thermoextruded or thermoset rubbery embodiments such as those made from thermoplastic elastomers. Examples of synthetic yarns include nylon, polyester, and spandex (polyurethane) yarns. Embodiments may also comprise stretch materials and designs, mesh fabrics, recycled and flexible materials, cottons, polyester, rayon, spandex, fleece, leathers and synthetic leathers such as cabretta leather, rubbers, plastics, woven fabrics, non-woven fabrics, cloths, LYCRA, a vinyl material, a neoprene material, a fleece material, COOL MAX fabric, or wicking materials to wick moisture away form a user's skin, or combinations thereof.

Many embodiments will generally be constructed with the same or similar materials forming both the palmar and dorsal segments of the glove for the most part. Some embodiments, however, may have the palmar segment formed of a more durable material, such as cabrettea leather, while the dorsal segment may be made of a more elastic material, such as nylon, a LYCRA mesh, wicking materials, or lighter materials that minimize moisture build up.

Construction of the present invention may be accomplished by any standard methods, such as, for example, by designing the dorsal and palm sections to meet along a conjoining lateral edge to define a pocket for receiving the eminence of a user's hand, and sewing said sections together. Other standard methods of construction could certainly be used, of course.

As has been discussed, one sport that will clearly benefit from the present invention is golf. The present invention will meet an unmet need by significantly and substantially improving prior art gloves for the weak hand. Prior art does not allow a golfer to take complete advantage of his or her preferred grip because they are not configure to meet the unique requirements of a golfer using the interlocking grip method or the interlocking grip method, for example, and thereby not currently being able maximize hand coordination throughout the golf swing. Embodiments overcome this oversight.

For example, although the basic interlocking grip method is to interlock the weak hand's forefinger with the strong hand's pinkie finger, there are slight variations as to the exact or preferred location of where the strong hand's pinkie finger resides. Some interlock users place their interlocked pinkie finger mostly between the weak hands forefinger and middle finger. This variation keeps a user's hands firmly and closely together. Other interlock method users prefer to overlay their interlocked pinkie finger primarily on top of, or on the dorsal segment of, the forefinger's proximal phalanx. The present invention provides solutions for those variations, and others, for superior effectiveness.

Likewise, there are slight variations as to the exact or preferred location of where the strong hand's pinkie finger resides when using the overlapping grip method, the most common grip among male and female golfers. Generally, one takes the strong hand's pinkie finger and places it between the index and middle finger on the weak hand. Other overlapping grip method users prefer to place the strong hand's pinkie finger more directly on top of the weak hand's middle finger. The present invention provides solutions for those variations as well, for superior overall grip and golf club control.

One embodiment, for example, comprises a grip enhancing means on the region of the glove that resides generally between the forefinger and the middle finger segments. The grip enhancing means of this embodiment provides the user with the ability to create a firmer grip on the golf club primarily because the user can use his pinkie finger to better hold onto the weak hand due to the grip enhancing means. The grip enhancing means for this embodiment, for example, may comprise a plurality of projections formed from a skid resistant material, such as neoprene. The projections can form a pattern on the selected surface area, such as lined up to form an arrow shape. Preferably, the high friction surface may include interstices or spaces between projections to allow for necessary flexibility. Preferably, the projections can have an average height of about 700 micrometers. Other similar embodiments can have uniform heights of say, 600 micrometers to three or four millimeters or more.

This and other embodiments now allow far greater feel and coordination lost with prior art especially when gripping a golf club using the conventional interlocking grip method, for example. The interlocked fingers now allow for far better grip and golf swing control because the interlocked pinkie finger is now provided with the ability to better grip the back of the weak hand.

An example of a similar glove embodiment that will provide superior advantages over prior art in the sport of golf would be to provide a grip enhancing means along the side and dorsal portion of the forefinger segment in order to significantly improve grip and coordination by the strong hand, to more effectively control the golf swing, and to provide greater golf swing consistency. The grip enhanced means of this embodiment provides the user with the ability to create a firmer grip on the golf club primarily because the user can use his pinkie finger to better hold onto the weak hand due to the grip enhancing means along the forefinger's dorsal segment as well as along the side of the forefinger segment, adjacent the middle finger segment.

In addition, providing a grip enhancing means on the side of the forefinger's proximal phalanx segment, adjacent to the thumb, allows the weak hand's forefinger to establish a better hold on the strong hand's ring finger when they touch, thus providing a truer connection between the two hands while gripping a golf club. The grip enhancing means may comprise of grooves, for example, depressed about 600 micrometers, for example.

This and other embodiments may be in the form of a standard synthetic leather golf glove, with the dorsal and palmar surface areas essentially covering all five metacarpals, with the exception of a slit along the dorsal surface which allows the golfer to insert the hand into the glove, and micro recesses along portions of the glove to allow for ventilation.

Users who prefer this embodiment will greatly benefit from significantly increased grip between both hands, for example, by providing grip support for the overlapped fingers, as well for the abutting weak hand's forefinger with the strong hand's ring finger, creating a far greater unified golf club swing.

The increased grip capabilities will provide a user with more stable grip capabilities to coordinate a golf swing, and help minimize even a modest amount of unnecessary movement between both hands, and to more properly adjust his or her next golf swing. Embodiments of the present invention offer these significant improvements and solve an unrecognized problem in prior art.

As can be seen, among the benefits of the present invention include: the ability to offer greater golf consistency and accuracy by solving this previously unsolvable problem in prior art; a far more successfully coordinated golf swing, and; and heightened ability to better achieve a square club face at impact with the golf ball.

Embodiments will significantly improve one's ability to maintain both hands throughout the golf swing thereby overcoming the limitations of prior art golf gloves.

The added benefits from the present invention of course offer added capabilities and therefore new ways of swinging a golf club. For example, those using the interlocking grip method may now use an embodiment uniquely configured for those using the interlocking grip method. Once the golfer places the glove on the weak hand, the strong hand's pinkie finger interlocks with the weak hand's forefinger. As the golfer begins the backswing the strong hand's pinkie finger provides modest pressure along the strong hand's dorsal segment that offers a grip enhancing means (say PVC dots). As the golfer begins the downswing, both hands being unhinging in greater unison.

Those using the overlapping grip method may also now use an embodiment uniquely configured for those using the overlapping grip method. Once the golfer places the glove on the weak hand, the strong hand's pinkie finger is placed over the weak hand's forefinger dorsal segment. As the golfer begins the backswing the strong hand's pinkie finger provides modest pressure along the strong hand's dorsal segment that offers a grip enhancing means (say depressed grooves). As the golfer begins the downswing, both hands being unhinging in greater unison.

SUMMARY

Many features can be used in conjunction with each other to uniquely solve problems that have up until now been unsolved, and some perhaps also unrecognized.

In general, embodiments of the present invention can be used in conjunction with any type of hand task activity or sports play. As discussed, embodiments offer an individual with the opportunity to increase overall hand task performance thereby maintaining or increasing overall control of a golf club throughout the golf swing.

These and other embodiments:

offer the ability to grip as well as feel a sports device, such as a golf club provide a unique solution for users who desire better grip capabilities only in select areas offer a more stabilizing overall grip of an object by conveying grip-enhancers to select locations of the back of the hand portions of a glove provide grip enhancers along the connecting area between the middle finger and forefinger segments permit the ability to use a glove on a weak hand configured to meet the unique needs of a user's preferred golf grip, especially for those using an interlocking grip or overlapping grip method improve performance in hand task execution by providing heightened hand coordination capabilities throughout a golf swing offer more control capabilities for the interlocked pinkie finger, a valuable feature when impacting a golf ball with greater velocity allow more hand coordination by adjusting a grip enhancing means to match a preferred variation of the interlocking golf grip method decrease the likelihood of golf slices because of less chance of hand separation during a golf swing offer more control capabilities for the overlapped pinkie finger, a valuable feature when impacting a golf ball with greater velocity allow more hand coordination by adjusting a grip enhancing means to match a preferred variation of the overlapping golf grip method increase the possibility for a squarer golf clubface at impact with the golf ball thereby improving ball contact, trajectory and accuracy provide a much improved method of playing the sport of Golf by using grip enhancers not just for the weak hand but also for the strong hand's pinkie finger as well, without limiting the feel and coordination requirements in a proper golf swing create a more strategically placed moisture management system that is more appropriately suited for golfers who use the interlocking grip method provide added grip for golfers with relatively smaller hands provide added grip for golfers with relatively weaker hands provide added control for golfers who desire a more unified hand grip on the golf club create a more strategically placed moisture management system that is more appropriately suited for golfers who use the overlapping grip method provide a solution for golfers who find their hands becoming separated during a golf swing These are among the many benefits of the present invention, and are not to be construed as limitations of the benefits nor their legal equivalent.

Although the description of the present invention only discussed the sport of Golf, it is understood that individuals playing other sports might benefit as well, such as volleyball, where a player often impacts a volleyball with the side of his or her thumb or forefinger.

Furthermore, only some embodiments have been discussed and in no way is intended to limit all the various embodiments and other embodiments that the present invention provides. Embodiments can of course be used by men and women, boys and girls, professional athletes or amateurs, as well as by those whose dominant hand is the right hand or the left.

BRIEF DESCRIPTIONS OF THE DRAWING

It is expressly understood that the following descriptions and drawings are for illustration purposes only, and in no way are intended to limit the scope of the present invention and its various embodiments. For example, the drawings are of embodiments for the left hand but can easily be created for the right hand.

Figure 3:
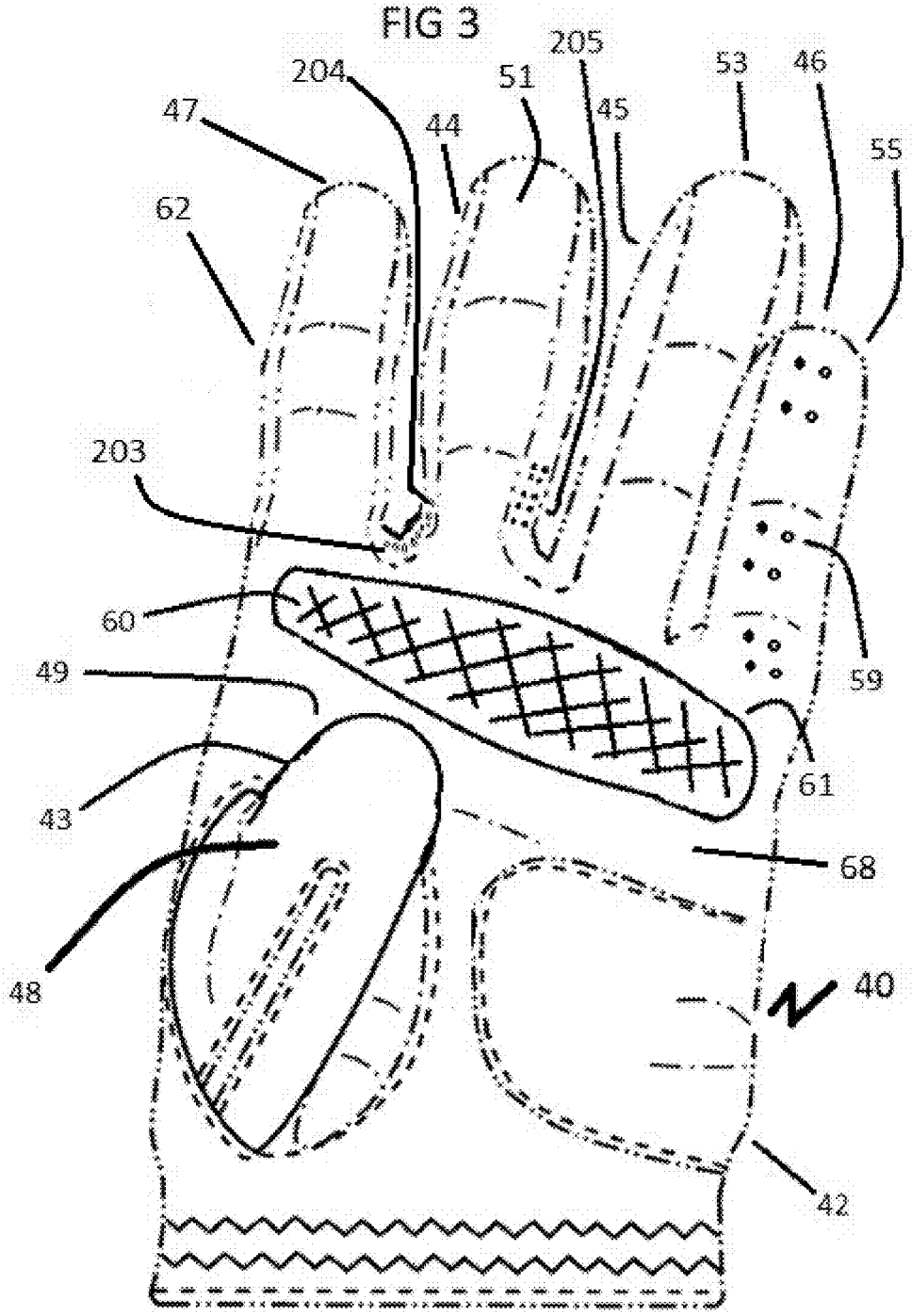
FIG. 3 is a drawing of the palmar view of a second embodiment, where the pinkie finger palmar digital segment comprises a grip enhancing means.
Figure 5:
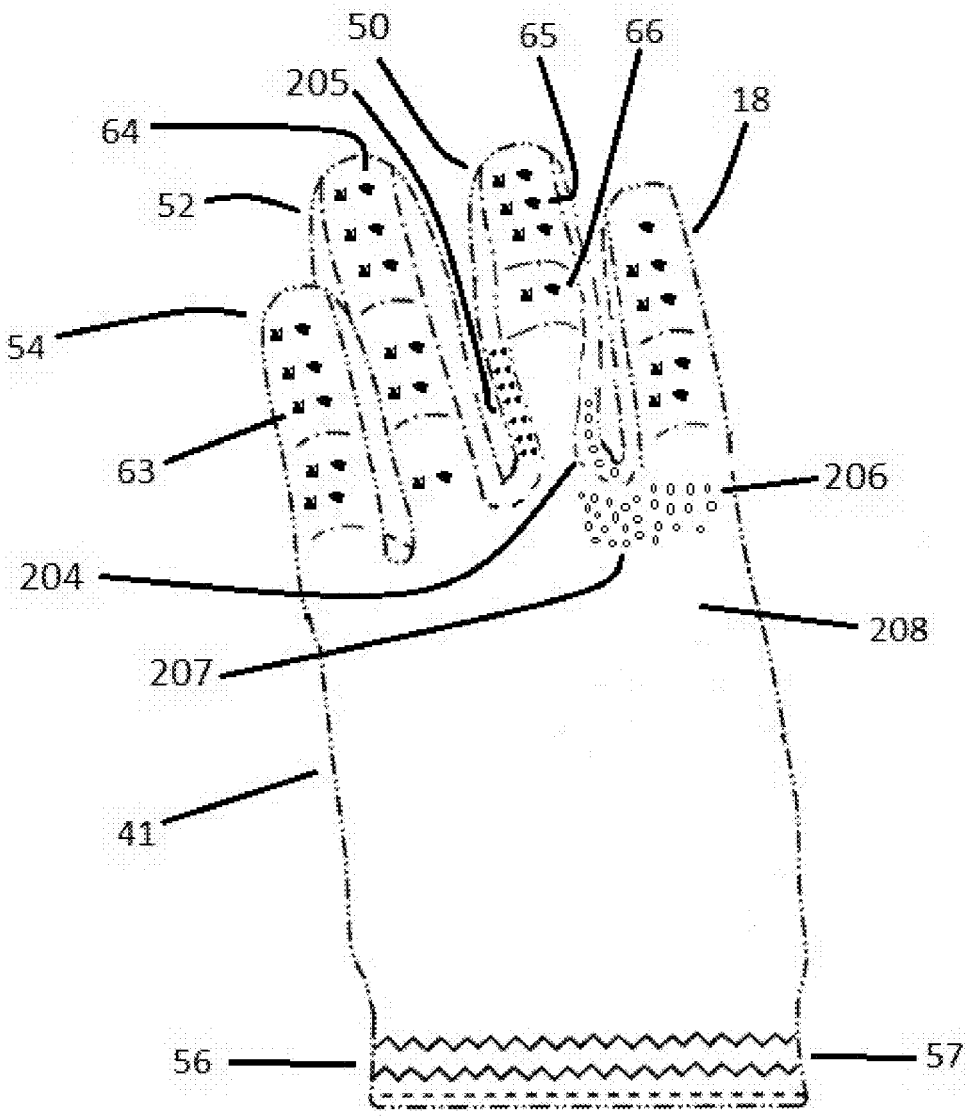

FIG. 5 is a drawing of the embodiment as described in FIG. 3, showing the dorsal view, where the region between the middle finger and a user's forefinger comprises a grip enhancing means; the side of the middle finger proximal phalanx segment comprises a grip enhancing means; and portions of the dorsal segment on, around and between the glove overlaying the forefinger and middle fingers metacarpophalangeal joints of this embodiment comprises a grip enhancing means, all in the form of PVC dots.

Figure 6:
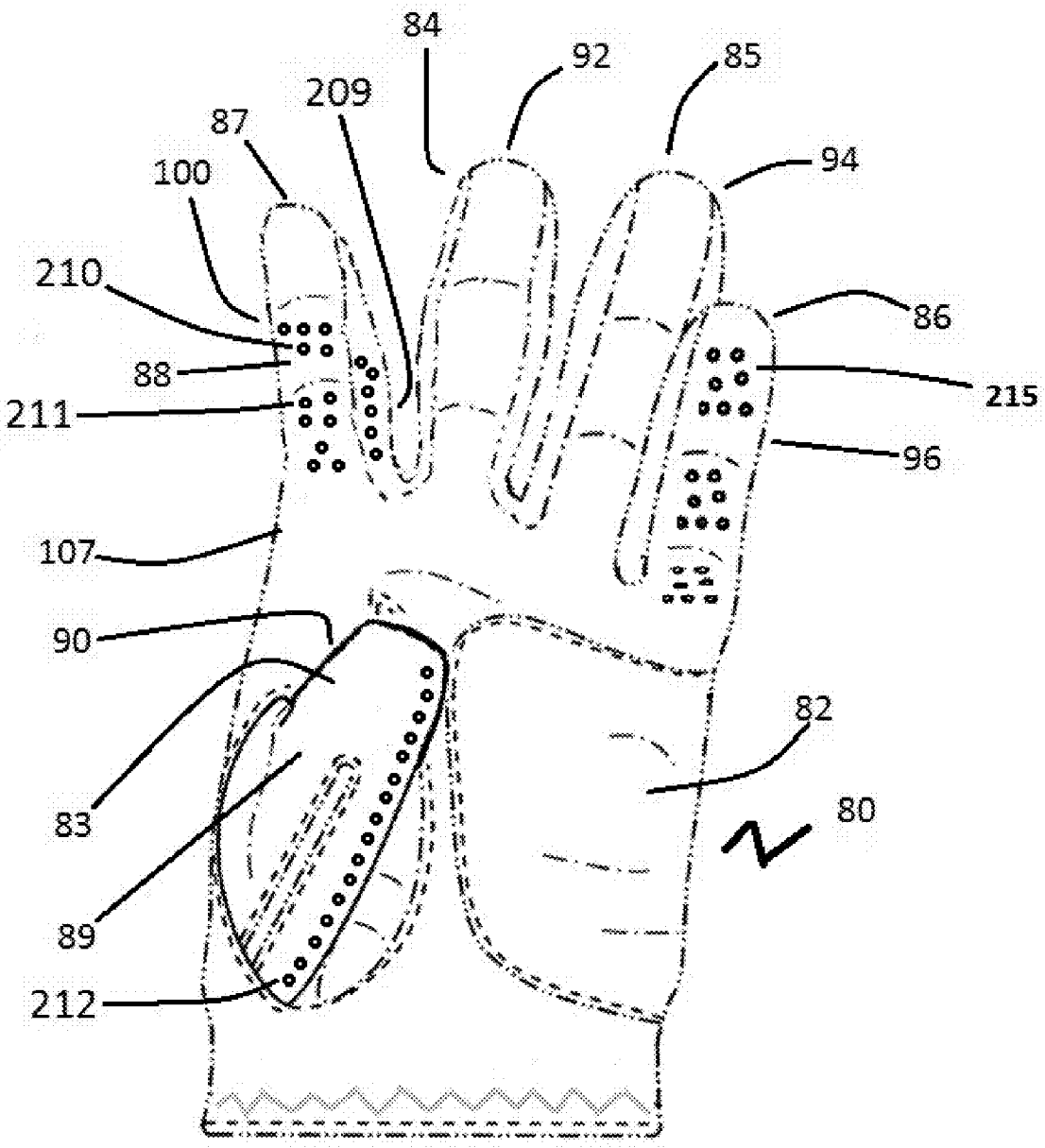

FIG. 6 is a drawing of the palmar view of a third embodiment, where a grip enhancing means also comprises high friction surfaces on the palmar surface of the pinkie segment, and on the palmar surface of the forefinger segment.

Figure 7:
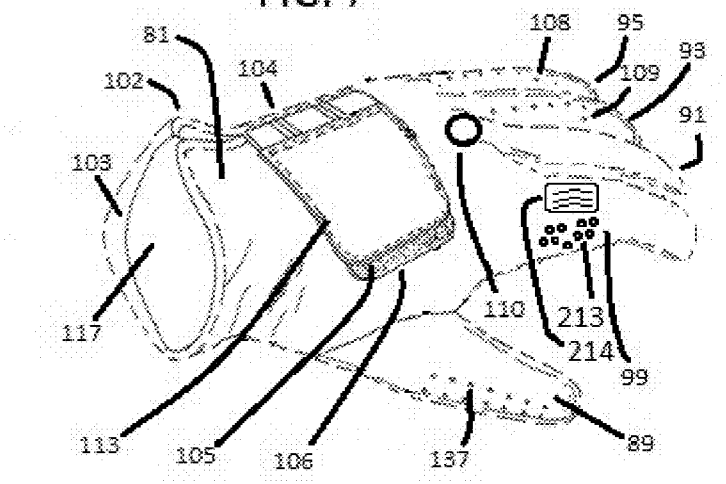

FIG. 7 is a drawing of the embodiment as described in FIG. 6, dorsal view, where a grip enhancing means is also provided on the side surface of the forefinger's proximal phalanx adjacent the middle finger segment, on the side surface of the forefinger's proximal and middle phalanges adjacent the thumb segment, on the dorsal surface of the forefinger segment, and on the side surface of the thumb segment.

Figure 8:
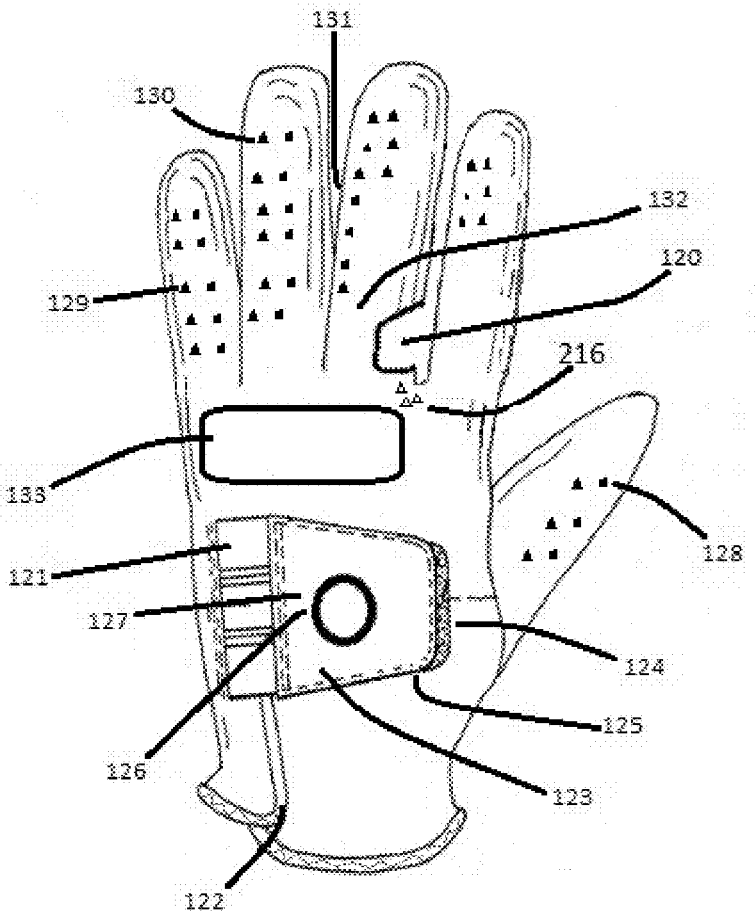

FIG. 8 is an alternative dorsal segment to FIG. 3.

Figure 9:
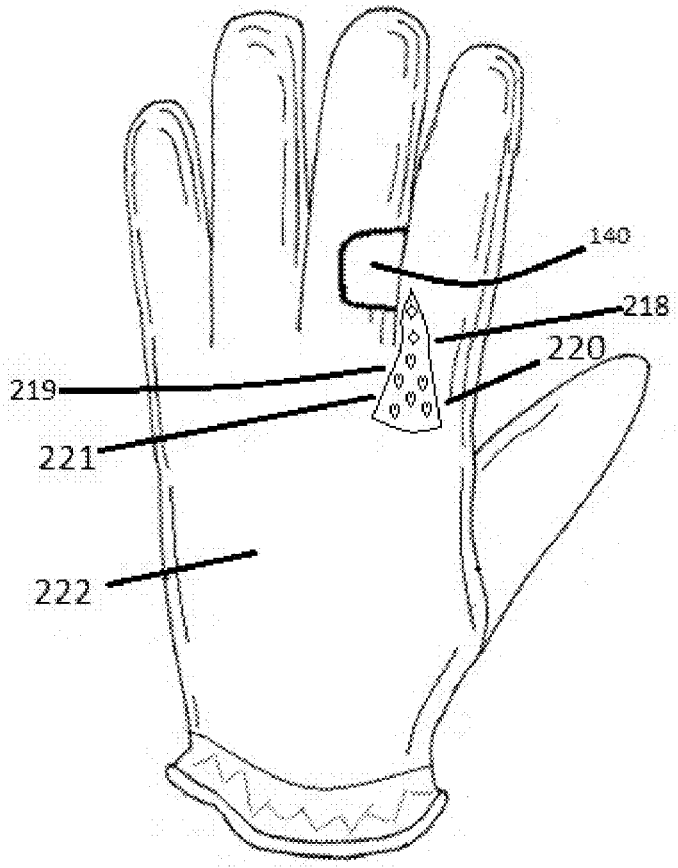

FIG. 9 is an alternative dorsal segment to FIG. 6.

Figure 10:
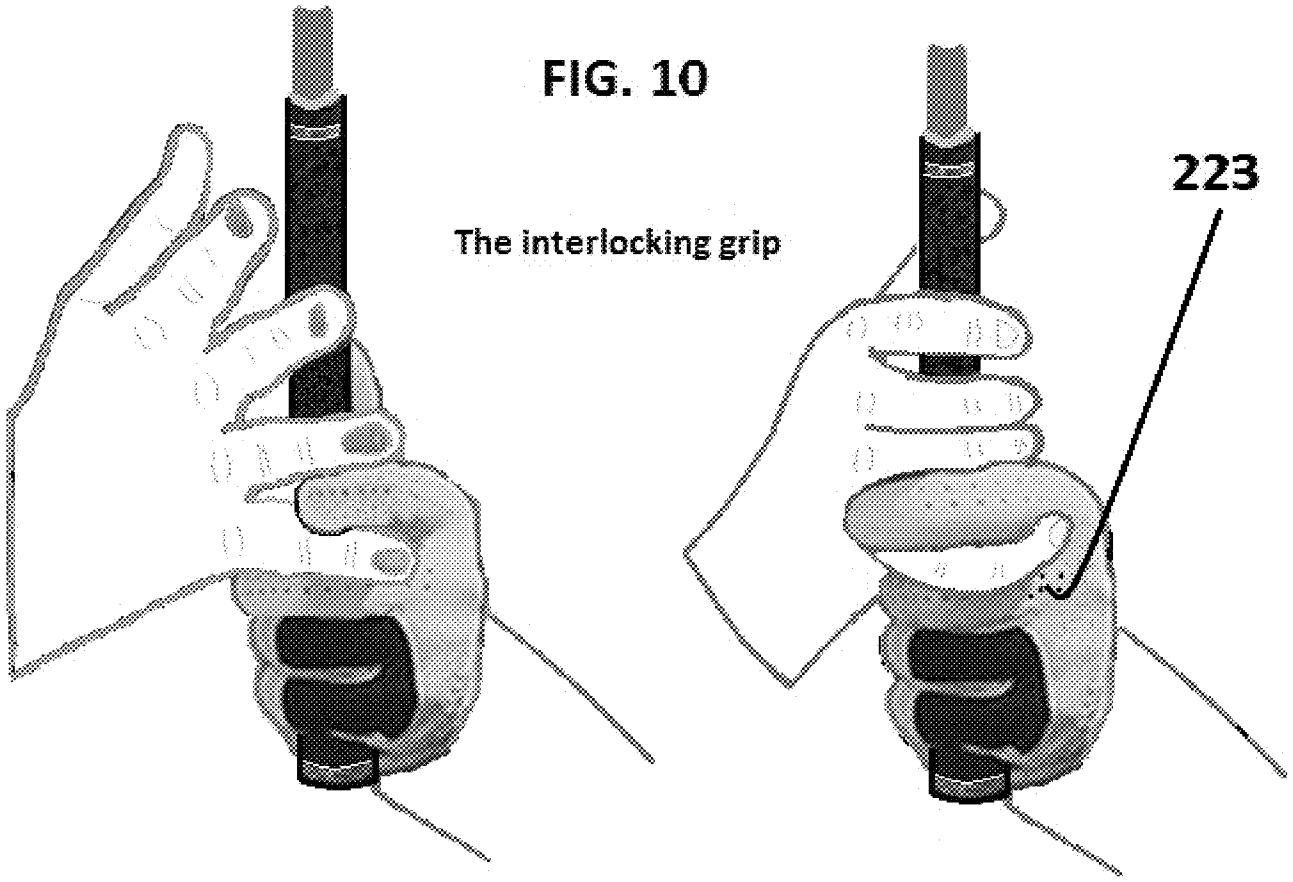

FIG. 10 shows a typical interlocking grip using a conventional prior art glove.

Figure 1:
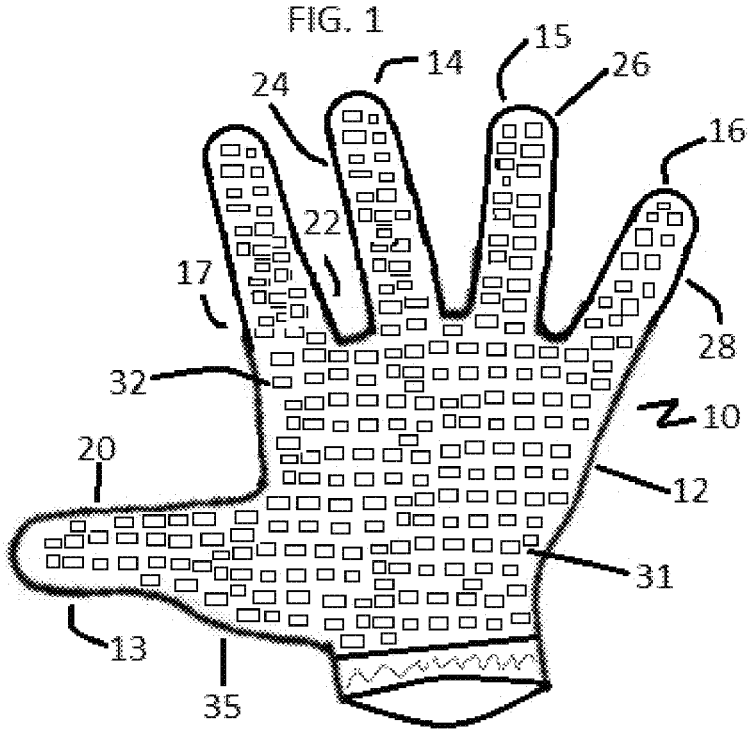
FIG. 1 is a drawing of the palmar (front) view of an embodiment where the grip enhancing means comprises a high friction surface on the entire palmar surface of the glove, including the palmar surfaces of the thumb segment and any existing finger segments.
Figure 11:
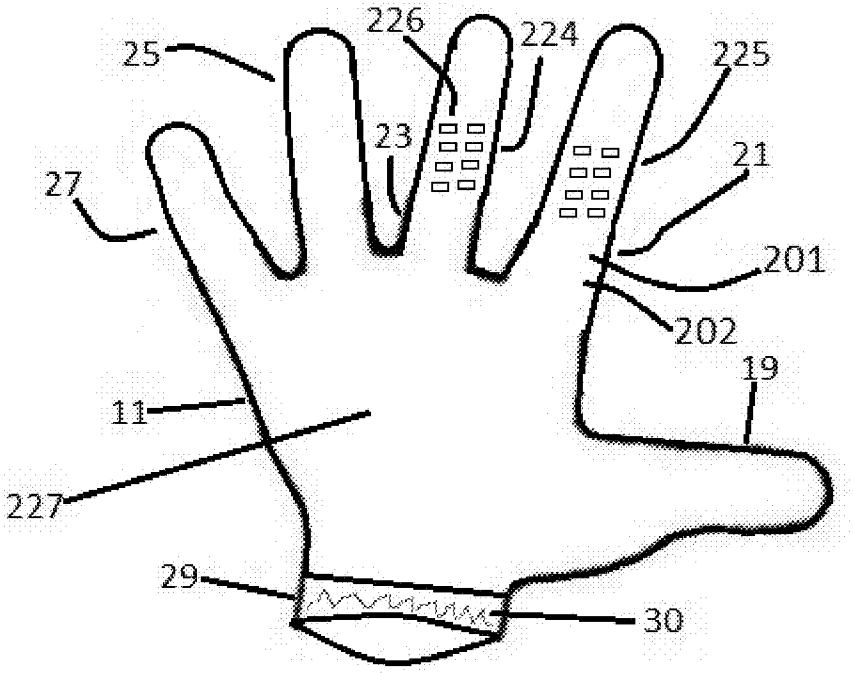

FIG. 11 shows an alternative dorsal segment to FIG. 1.

Figure 12:
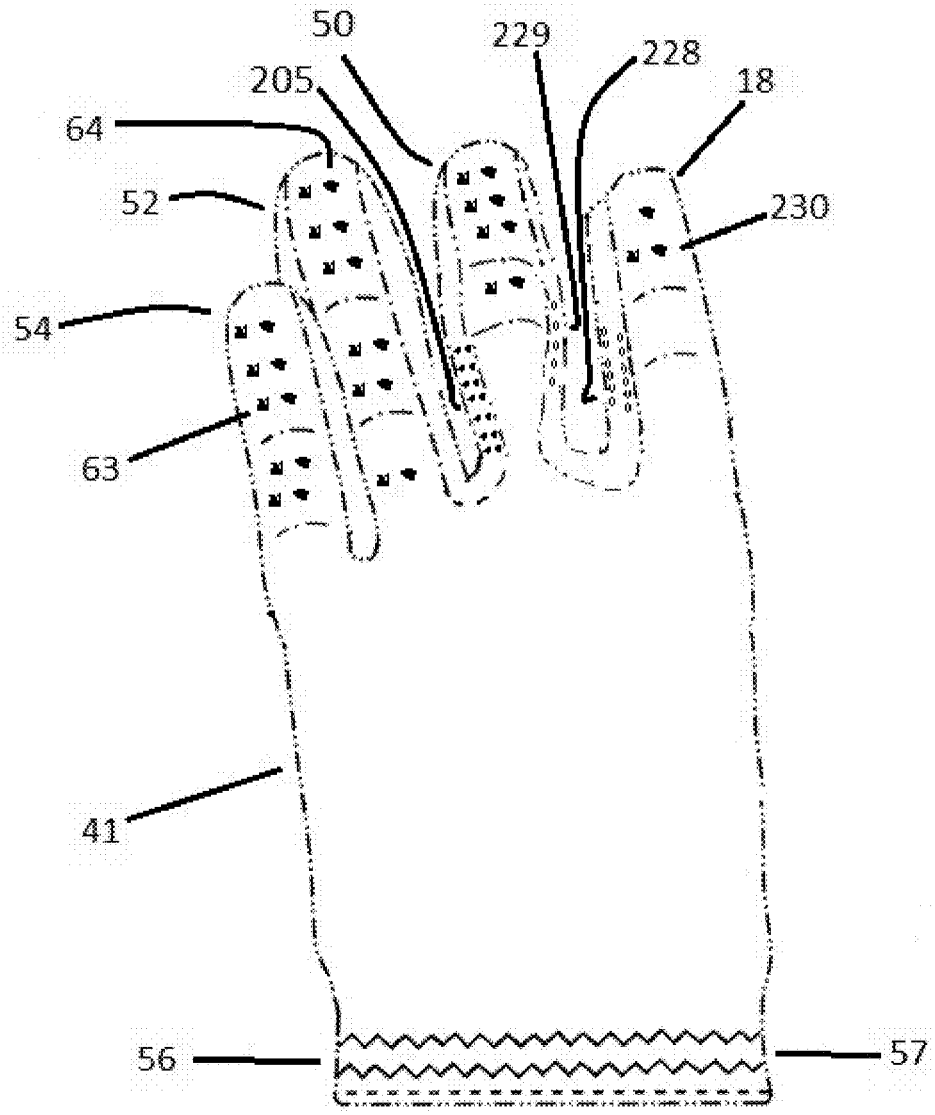

FIG. 12 shows a second alternative dorsal segment to FIG. 3, where a grip enhancing means is provided on the side portion of the forefinger segment, in addition to the grip enhancing means on the middle finger segment.

Figure 13:
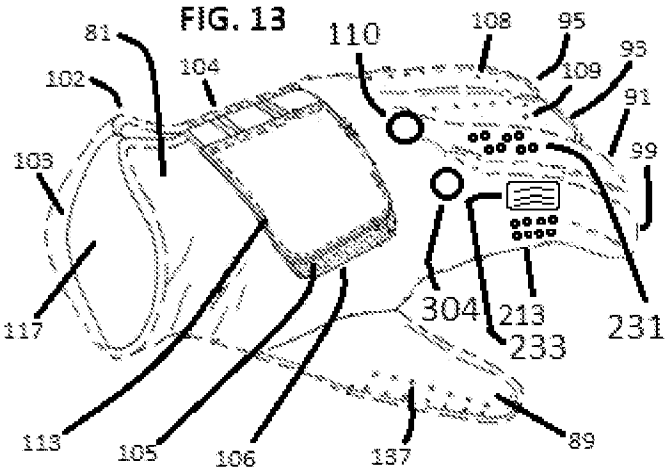

FIG. 13 shows a second alternative dorsal segment to FIG. 6, where a grip enhancing means is provided on the dorsal portion of the middle finger segment, in addition to the grip enhancing means on the forefinger segment.

Figure 14:
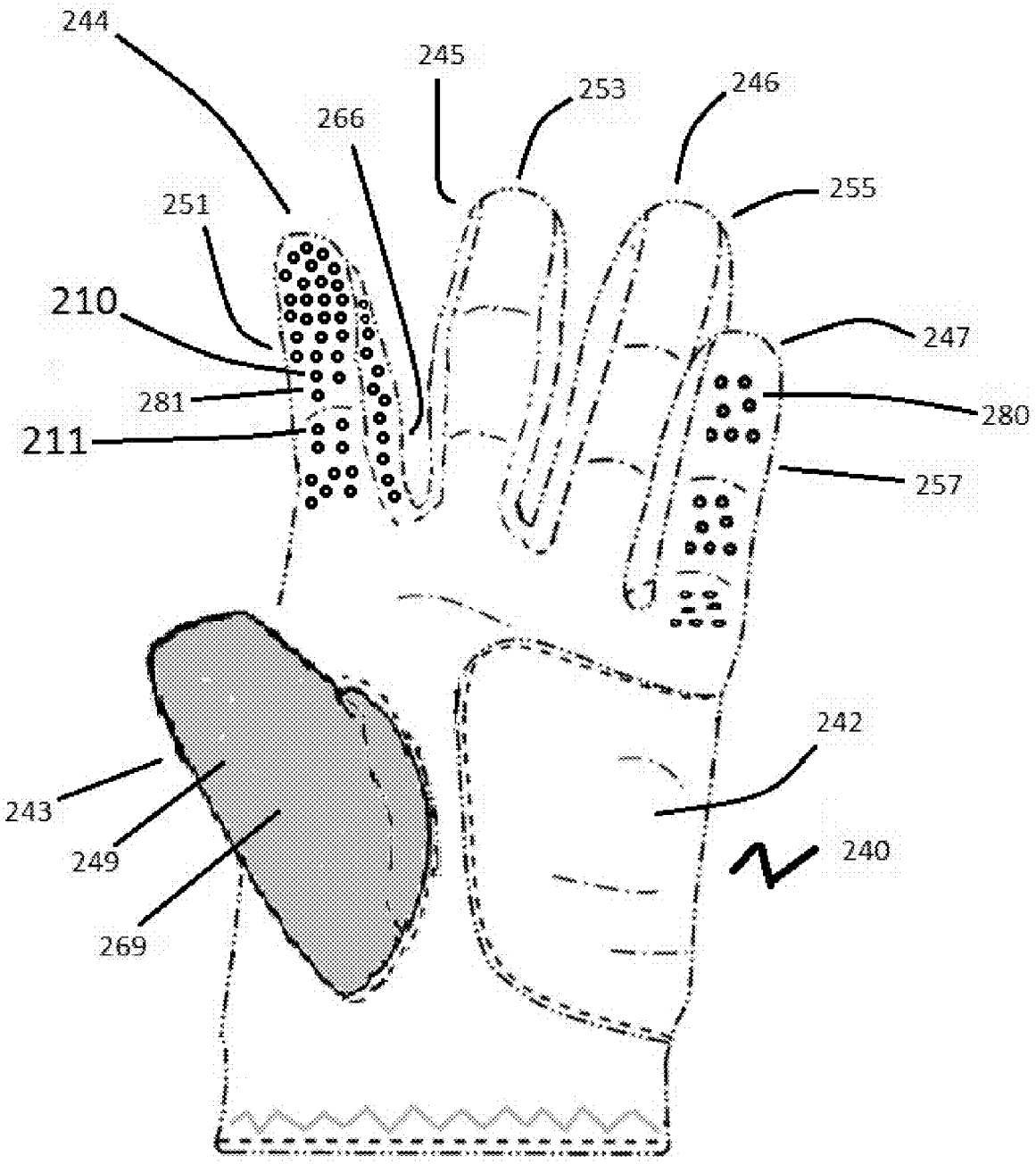

FIG. 14 is a drawing of the palmar view of another embodiment, where a grip enhancing means also comprises the palmar surface of the pinkie segment, throughout the entire palmar surface of the forefinger segment, and on the entire palmar surface of the thumb segment.

Figure 15:
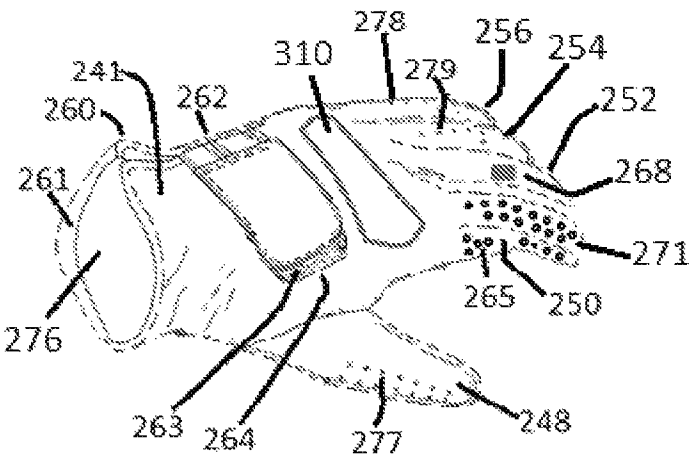

FIG. 15 is a drawing of the embodiment as described in FIG. 14, dorsal view, where a grip enhancing means is provided throughout both side surface areas of the forefinger segment, throughout the entire dorsal surface of the forefinger segment, and along the proximal phalanx of the middle finger's dorsal portion.

Figure 16:
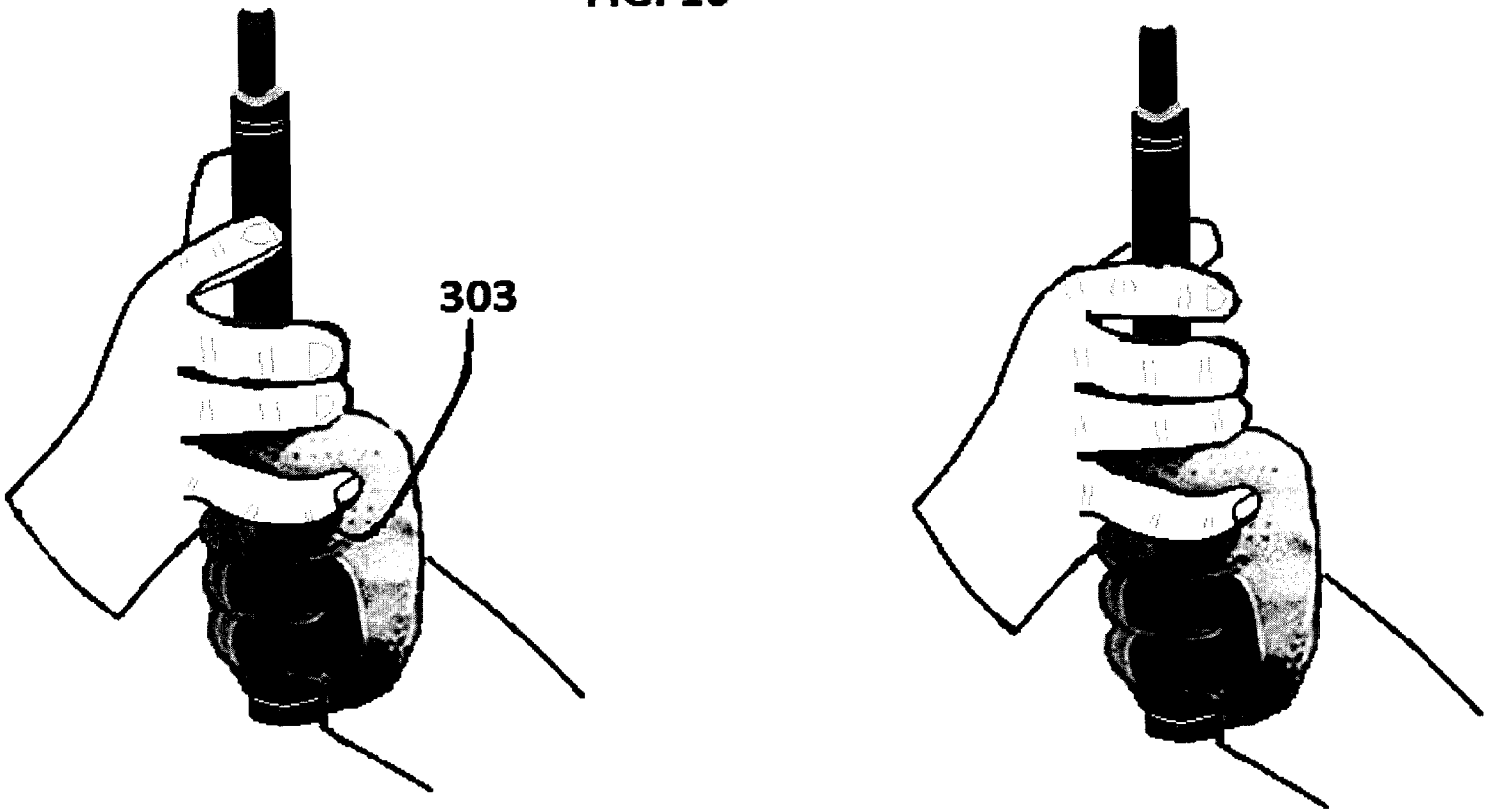
FIG. 16 (RELATED ART)

FIG. 16 shows a typical overlapping grip using a conventional prior art glove.

DETAILED DESCRIPTION OF THE DRAWINGS

It is expressly understood that the drawings are for the purpose of illustration and description only and are not intended as a definition of the limits of the invention.

Figure 2:
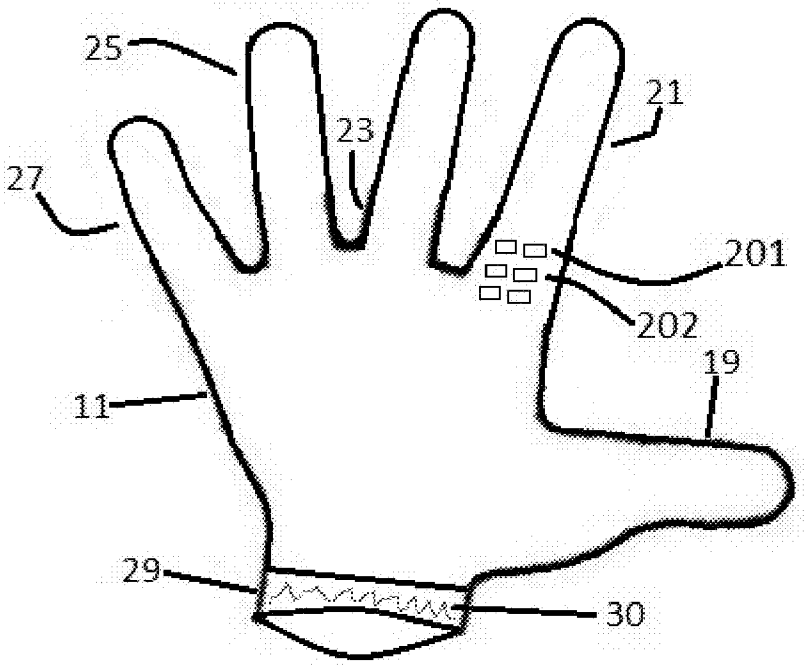
FIG. 2 is a drawing of the embodiment as described in FIG. 1, showing the dorsal (back) view, where a grip enhancing means is provided on the proximal phalanx of the forefinger's dorsal segment.

Referring now to FIG. 1 and FIG. 2, an embodiment of the present invention is shown and designated as 10. The palmar view of a left-handed glove is drawn in FIG. 1 and the dorsal view of the same glove is drawn in FIG. 2. This embodiment shows a glove having a dorsal portion 11, a palmar portion 12 for overlaying respective back and palm regions of a human hand, said dorsal and palmar portions having distal and proximal ends with a plurality of digital segments (or stalls) projecting from said distal ends. The glove includes a glove body having a back portion covering the back of the hand 11, and a front portion covering the palm or front of the hand 12. The glove body includes finger stalls (or digital segments) and a thumb stall (digital segment) each adapted to receive a finger or thumb, respectively, therein.

In the illustrated embodiment the glove is constructed such that the thumb 13 digital segment encloses said thumb, including enclosing the fingertips. The glove has a middle finger digital segment 14 that encloses the middle finger, including the fingertips, a ring finger digital segment 15 that encloses the ring finger, including the fingertips, and a pinkie finger digital segment 16 that covers the pinkie finger, including the fingertips of a user. In addition, the glove has a forefinger digital segment 17 that covers the forefinger of a user, defining the digital segments terminal edges.

The palmar section also covers the palm segment overlaying the palm of the hand 12; the dorsal section overlays the back of the hand 11. The glove also has a wrist portion that surrounds the wrist of a user.

The thumb stall 13 is defined by a dorsal portion 19 and a palmar portion 20. The forefinger stall 17 is defined by a dorsal portion 21 and a palmar portion 22. The middle finger stall 14 is defined by a dorsal portion 23 and a palmar portion 24. The ring finger stall 15 is defined by a dorsal portion 25 and a palmar portion 26. The pinkie finger stall 16 is defined by a dorsal portion 27 and a palmar portion 28.

The wrist portion is preferably expansible so as to hold more securely to the user's wrist. Therefore the embodiment also has an expandable opening means 29 at a wrist end 30 adapted to receive the user's hand. The expandable opening means comprises an elastic material along the wrist portion, such as an elastomeric band 29 fixed around the wrist. If desired, the opening means may comprise a strap means at the open end of the glove body for fastening the glove body secure about the wrist area, or a combination thereof. The strap may have two pads of cohesive-adhesive material for releasably securing the strap. The strap as well as this wrist portion may be sewn onto the glove, for example.

This embodiment further shows how the present invention may comprise a grip enhancing means on the palmar or the dorsal segments.

In the illustrated embodiment, the grip enhancing means comprises high friction surfaces 31 and 201, on the entire palmar surface of the glove 12, including the palmar surfaces of the thumb segment 20 and any existing finger segments 22, 24, 26 and 28, as well as only on the proximal phalanx of the forefinger's dorsal segment 201. Preferably, the high friction surface is formed from a PVC material, a nitrile material, a latex material, or a rubber material (as shown) 35. The surface may include a depression or projection pattern formed from the high friction material. Formed on the illustrated material is a plurality of square-like projections 32 and 202 that are applied to the entire palmar surface area and the select area of the dorsal surface by any standard means, as aforementioned, defining the respective boundaries. These square-like projections preferably are spaced apart to allow for added grip and flexibility.

The palmar segment of the embodiment may be generally cabretta leather 12 whereby the rubber projections may be applied. Alternatively, the entire palmar segment may comprise of a rubber material, whereby the projections may be formed from the palmar segment. The palmar segment can then be conjoined to the dorsal segment, thus creating the glove. Preferably, the heights of the embodiment's projections are such that the gap formed by the projections allow for some movement of the affected surfaces thereby increasing the grip capabilities of the user. The height can generally begin at about one hundred micrometers to several millimeters or more. For example, these projections are about two hundred micrometers in height, about two millimeters in width and four millimeters in length.

The dorsal segment is preferably of similar material as the palmar segment 11. It may, of course comprise of a different material than the palmar surface, such as a more durable fabric, but would preferably also be rather flexible. If the dorsal surface is comprised of a more durable fabric, such as synthetic leather, then some added elasticity capabilities may be also preferable, though not required, on select area of the dorsal surface, in particular around the metacarpophalangeal joints. For example, the dorsal surface may comprise of an aperture on the forefinger's metacarpophalangeal joint, the middle finger's metacarpophalangeal joint, the ring finger's metacarpophalangeal joint, and on the pinkie finger's metacarpophalangeal joint. Alternatively, embodiments may simply comprise of a more elastic material, such as any of those aforementioned such as spandex, on the dorsal surface overlaying said metacarpophalangeal joints, or seams or slits, while the rest of the dorsal surface is comprised of a more durable material. The elastic material could be stitched onto those areas, and therefore replacing the more durable materials along those select areas.

The palmar and dorsal segments, and any wrist portions, may then be conjoined on any finger and thumb portions, dorsal and palm portions and a wrist portion using any standard methods, such as by stitching, thus defining a pocket for receiving a user's hand.

As aforementioned, this embodiment provides users with several benefits, in multiple sports. For example, those playing the sport of golf may use this embodiment on their weak hand thereby allowing the golfer significantly more grip capabilities on key areas of the interlocked forefinger with the ungloved pinkie finger.

Figure 4:
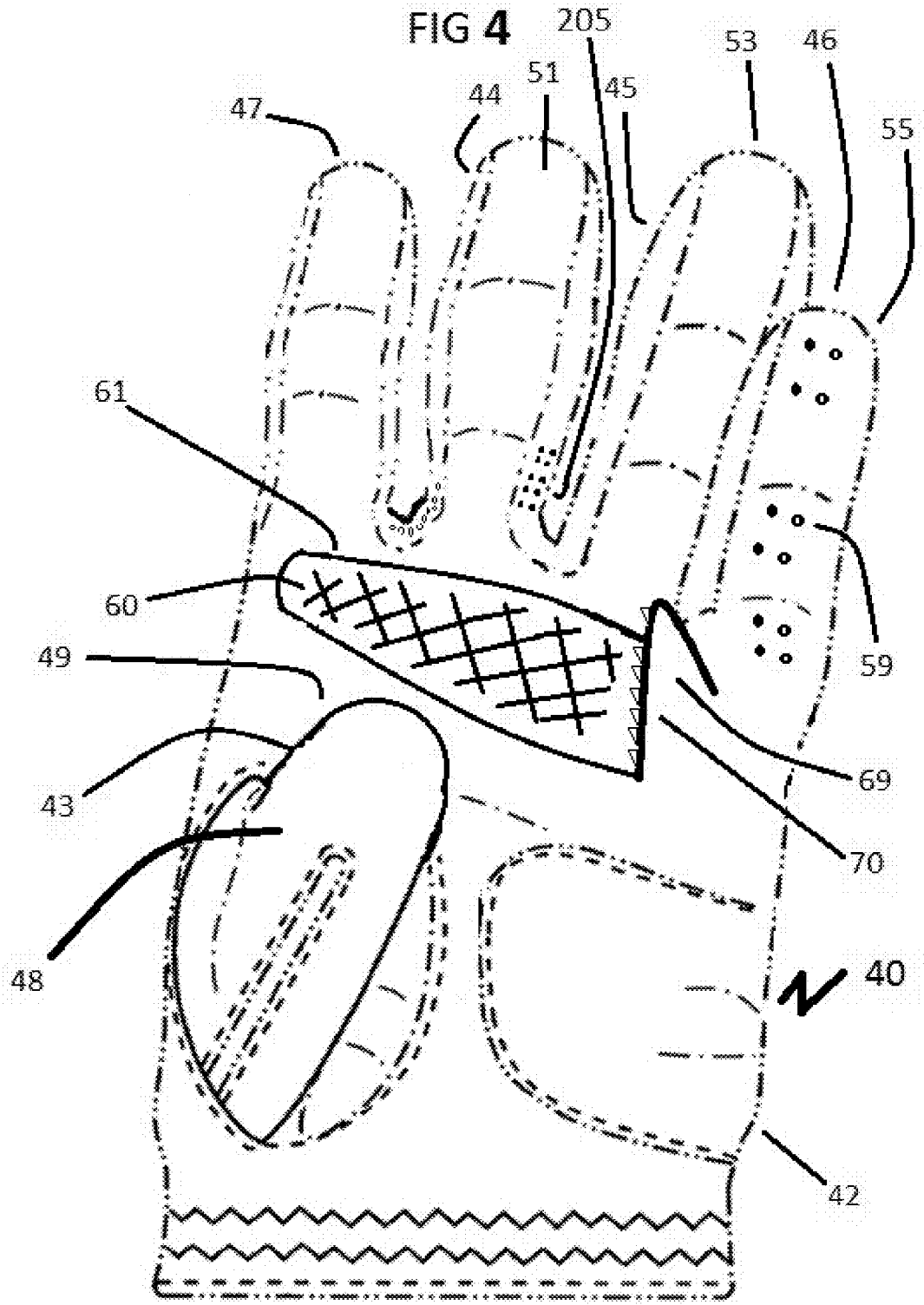
FIG. 4 shows the top and bottom view of a panel which creates a higher friction surface on an embodiment, as shown in FIG. 3.

Referring now to FIG. 3, FIG. 4 and FIG. 5, a second embodiment of the athletic glove of the present invention is shown and designated as 40. The palmar (front) view of a left-handed glove is drawn in FIG. 3 and the dorsal (back) view of the same glove is drawn in FIG. 5. This golf glove embodiment provides a glove having a dorsal portion 41 and a palmar portion 42 for overlaying respective back and palm regions of a human hand, said dorsal and palmar portions having distal and proximal ends with a plurality of digital segments (or stalls) projecting from said distal ends. The glove includes a glove body having a back portion covering the dorsal surface of the hand 41, and a front portion covering essentially the entire palm surface of the hand 42. The glove body includes finger segments and a thumb segment each adapted to receive a finger or thumb, respectively, therein.

In the illustrated embodiment, the glove is constructed such that the thumb 43 digital segment encloses said thumb, including enclosing the fingertips. The glove also has a middle finger digital segment 44 that covers the middle finger, including the fingertips, a ring finger digital segment 45 that covers the ring finger, including the fingertips, a pinkie finger digital segment 46 that covers the pinkie finger, including the fingertips of a user, and a forefinger digital segment 47 that covers the forefinger, including the fingertips of a user.

The palmar surface of this glove embodiment therefore essentially covers the rest of the front of the hand, including the entire palm of the hand 42; the dorsal section covers most of the rest of the back of the hand 41, allowing for possible micro-recesses for ventilation.

The thumb stall 43 is defined by a dorsal portion 48 and palmar portion 49. The middle finger stall 44 is defined by a dorsal portion 50 and a palmar portion 51. The ring finger stall 45 is defined by a dorsal portion 52 and a palmar portion 53. The pinkie finger stall 46 is defined by a dorsal portion 54 and a palmar portion 55. The forefinger stall 47 is defined by a dorsal portion 18 and a palmar portion.

The glove also has an expandable opening means at a wrist end portion 56 adapted to receive the user's hand. The expandable opening means comprises an expandable opening means comprised of an elastic material such as an elastomeric band 57 fixed around the wrist to expand and contract for easier glove application onto a hand. The wrist portion is preferably expansible so as to hold more securely around the user's wrist. As with other embodiments, the glove may alternatively, or additionally, have a strap means at the open end of the glove body for fastening the glove body secure about the wrist area. The strap means may be unitary with the glove body and may include VELCRO fasteners, buttons, and the like or other suitable closure means thereon.

This embodiment further shows how the present invention may comprise a grip enhancing means on select segments of the glove, and provide a higher coefficient of friction than the surrounding areas of the grip enhancing means.

The pinkie finger palmar digital segment 46 comprises a grip enhancing means 59; the region between the middle finger and a user's forefinger 203 comprises a grip enhancing means; the side of the middle finger proximal phalanx segment 204 comprises a grip enhancing means; and portions of the dorsal segment on, around and between the forefinger and middle fingers metacarpophalangeal joints of this embodiment comprises a grip enhancing means 206 and 207, all in the form of PVC dots 59, 203, 204, 206, 207, respectively.

The PVC dots preferably project out at least about seven hundred micrometers. The PVC dots located on the palmar section of the pinkie finger stall are throughout said stall. Similar embodiments may have a grip enhancing means also along the thumb segment, or combinations thereof, to maximize grip abilities on the fingertips of the thumb and pinkie finger. This will allow for greater golf club grip retention especially throughout the down swing of a golf swing when some separation between the hands takes place. Providing the grip enhancing means on the dorsal portion and select side portions allow the ungloved pinkie finger to overlap or interlock and better grip the gloved weak hand, a major and necessary improvement.

The grip enhancing means of the present invention may be integral to the glove or may be affixed to the glove using any standard methods. For example, this embodiment comprises grip enhancing means that is integral to the glove, using any standard method known in the art. For example, the PVC dots can be imparted by any standard methods, such as, for example, by molding. The heights of the PVC dots in this embodiment are all the same height, and are generally in rows. Other embodiments could of course offer different heights, non-uniform heights, and have a more random pattern on the top surface.

The locations of the grip enhancing means may vary on several factors of course, such as personal preference and preferred degree of enhanced grip. This added grip configuration will be useful especially to golfers who use the interlocking grip method for purposes of unifying both hands throughout the golf swing, and for other reasons described herein.

For example, a grip enhancing means is provided on select areas of the dorsal surface of the embodiment. Specifically, the grip enhancing means is provided on and around the forefinger's metacarpophalangeal joint 206 but does not extend beyond the forefinger's metacarpophalangeal joint 208. Additionally, a grip enhancing means is provided between the forefinger's metacarpophalgeal joint and the middle finger's metacarpophalgeal joints 207, defining its terminal edges, but can also be configured to provide a grip enhancing means on a portion of the middle finger's metacarpophalangeal joint, but preferably generally not more than about fifty-percent.

The embodiment's grip enhancing means can also comprise of a high friction surface, such as creating crisscross projections 60 for example, to the glove area beginning at the digital creases and extending to overlay the forefinger metacarpophalangeal joint, the middle finger metacarpophalangeal joint, the ring finger metacarpophalangeal joint, and the pinkie finger metacarpophalangeal joint. The grip enhancing means portion overlaying the pinkie finger metacarpophalangeal joint may preferably not extend over the upper-palmar crease, however, to provide optimal flexibility, although some embodiments may extend to cover the entire pinkie joint.

The grip enhancing means can also comprise of a high friction surface by applying a non-slip coating, such as a latex, a nitrile or PVC coating, along described locations of this embodiment. The coating could of course also be applied to the entire palmar portion of the glove.

This grip enhancing means may also be affixed to the glove. In general, as aforementioned, a grip enhancing means may generally be either formed, affixed, or inserted, on any palmar portion, such as the palm or any thumb or any existing finger stalls, on the dorsal portion of the forefinger or middle finger segments ranging from the distal phalanges through their metacarpophalangeal joints, or on the sides of the thumb, forefinger or middle finger segments, ranging from the distal phalanges to through their metacarpophalangel joints, using any standard methods. The embodiment's grip enhancing means can comprise of a high friction surface, such as creating crisscross grooves 60 that are depressions onto a rubber surface panel 61, for example, then attaching said panel onto a portion of any of the above selected surface areas. The panel is attached to the palmar surface of the glove by any standard methods of attachment, such as by adhesion or stitching.

The panel may be is attached to the glove area, for example, beginning at the digital creases and extending to overlay the forefinger metacarpophalangeal joint, the middle finger metacarpophalangeal joint, the ring finger metacarpophalangeal joint, and the pinkie finger metacarpophalangeal joint, 62. The panel portion overlaying the pinkie finger metacarpophalangeal preferably does not extend over the upper-palmar crease, however, to provide optimal flexibility.

The panel may generally be comprised of any flexible material, for example, a plastic material having a top surface comprising the grip enhancing area formed by a plurality of depressions, such as, for example, ridges, and may be applied to any of the areas where the present inventions provides a grip enhancing means.

A preferred height of the crisscross projections would be such that the gap formed by the projections would allow for some movement of the newly formed top surface edges thereby increasing the grip capabilities of the user. This grip enhancing means could have a preferred height beginning about six hundred micrometers, and can be imparted by, for example, embossing or standard mechanical treatments.

Alternatively, this grip-enhancing means may be attached, affixed or otherwise placed to select areas of the glove by standard methods and forms of attachment such as by creating a textured surface on a silicone-based layer and then hot melting said silicone surface onto the palmar portion of the glove for example, thus providing a high friction surface on the embodiment. The panel could also be bonded to, and become a part of the glove as claimed, by any other standard method.

It will be apparent to one of ordinary skill in the art that many other implementations of creating and applying panels to sports gloves are possible.

The grip enhancing surface would thereby provide a higher and more effective coefficient of friction than on the surrounding areas.

The locations of the grip enhancing means may vary on several factors of course, such as personal preference and preferred degree of enhanced grip.

Additionally, projection (or depression) designs may vary, such as being in the form of non-linear or crisscross lines, for example. Finally, the heights may vary as well.

A plurality of micro recesses of about 0.120 millimeters in diameter may be randomly disposed about the front, back and finger and thumb stalls of the glove, thereby providing added comfort and more ventilation. The illustrated embodiment has micro recesses along and throughout the pinkie finger segment 63 and ring finger segment 64. Additionally, there are micro recesses along the distal 65 and middle phalanges 66 of the middle finger segment. An important aspect of this embodiment is that there are micro recesses only along the side of the proximal phalanx of the middle finger 205, adjacent the ring finger. When a user of this embodiment grips a golf club using the interlocking grip method for example, the strong hand's ungloved pinkie finger interlocks with the gloved weak hand thereby providing heightened a more sustainable grip throughout the interlocked fingers. However, as can be seen in FIG. 10, the strong hand's pinkie finger also comes into contact with the weak hand's middle finger segment—specifically with the middle finger's proximal phalanx. Providing micro-recesses along the middle finger's proximal phalanx should direct moisture away from the interlocked fingers. Therefore, this embodiment also solves an unrecognized configuration problem with prior art.

As aforementioned, the present invention, including this embodiment may be constructed using standard materials and methods of construction known in the art of making sports gloves. For example, construction of this embodiment may be accomplished by standard methods, such as, by designing the dorsal and palmar sections to meet along a conjoining lateral edge to define a pocket for receiving the eminence of a user's hand. Said dorsal and palmar sections could be conjoined by sewing, for example.

This embodiment further shows how the present invention may comprise of essentially the same materials to construct both the palmar and dorsal segments. This particular glove can be made of a polyester and cotton blend for superior comfort 40, say about seventy percent polyester. The polyester thread, for example, could be spun with the cotton yarns to produce the composite. Other materials that could comprise these glove embodiments include, but are not limited to woven materials that include natural, synthetic or blends of natural and synthetic yarns, flexible plastics, and thermoextruded or thermoset rubbery embodiments including those made from thermoplastic elastomers. Examples of synthetic yarns include nylon, polyester, and spandex (polyurethane) yarns, and LYCRA. Alternatively, the embodiment may simply comprise of standard synthetic leather and LYCRA.

Additionally, embodiments such as this one, may be completely coated with a with a water repellant substance, such as a synthetic resin 68 on the palmar surface or throughout the entire glove, including the glove dorsal segment's forefinger or middle finger.

This unique offering will significantly increase a user's ability to control a golf club and also therefore a more consistent golf swing.

Referring now specifically to FIG. 4, what is shown is the top (front) and bottom (back) portions of a panel which creates a higher friction surface on an embodiment, as shown in FIG. 3. What is shown is a panel overlaying much of the metacarpophalangeal joints of the forefinger, middle finger, ring finger, and pinkie finger stalls 62.

In general, as aforementioned, a grip enhancing means may be applied to any selected portions of the glove, such as the palm or any thumb or any existing finger stalls, using any standard methods.

This embodiment shows a grip enhancing means comprising of a high friction surface by providing crisscrosses 60 that are projections onto a rubber surface panel 61, for example, then attaching said panel onto a portion of the gloves palmar surface area. The bottom portion of the panel 69 is attached to the palmar surface of the glove by any standard methods of attachment, such as by an adhesive 70 or stitching.

Referring now to FIG. 6 and FIG. 7, an athletic glove of the present invention is shown and designated as 80. The palmar (front) view of a left-handed glove is drawn in FIG. 6 and the dorsal (back) view of the same glove is drawn in FIG. 7. This embodiment provides a glove having a dorsal portion 81, a palmar portion 82 for overlaying respective back and palm regions of a human hand, said dorsal and palmar portions having distal and proximal ends with a plurality of digital segments (or stalls) projecting from said distal ends. The glove includes a glove body having a back portion covering the back of the hand 81, and a front portion covering the palm or front of the hand 82. The glove body includes finger stalls and a thumb stall each adapted to receive a finger or thumb, respectively, therein.

In the illustrated embodiment, the glove is constructed such that the thumb segment 83, middle finger segment 84, ring finger segment 85 and pinkie digital segment 86 enclose said thumb, middle finger, ring finger, and pinkie fingers including enclosing the fingertips, respectively. The glove also has a forefinger segment 87 that encloses the forefinger including the fingertips.

The palmar section covers the entire palm of the hand 82 and the dorsal section covers the back of the hand 81. The glove also has a wrist portion that surrounds the wrist of a user.

The thumb stall 83 is defined by a dorsal portion 89 and a palmar portion 90. The middle finger stall 84 is defined by a dorsal portion 91 and a palmar portion 92. The ring finger stall 85 is defined by a dorsal portion 93 and a palmar portion 94. The pinkie finger stall 86 is defined by a dorsal portion 95 and a palmar portion 96. The forefinger stall 97 is defined by a dorsal portion 99 and a palmar portion 100.

The wrist portion is preferably expansible so as to hold more securely to the user's wrist. Therefore the embodiment also has an expandable opening means at a wrist end 102 adapted to receive the user's hand. The expandable opening means comprises an elastic material along the wrist portion, such as an elastomeric band 103 fixed around throughout the wrist. In addition, the opening means comprises a strap means 104 at the open end of the glove body for fastening the glove body secure about the wrist area. The strap means may be unitary with the glove body and may include VELCRO fasteners 105, 106, buttons, and the like or other suitable closure means thereon.

This embodiment further shows how the present invention may comprise a grip enhancing means on select portions of the glove, and thus providing a higher coefficient of friction than the surrounding areas of the grip enhancing means.

The grip enhancing means can comprise of a high friction surface by applying a non-slip coating, such as a latex, a nitrile 107 or PVC coating, along described locations of this embodiment, such as on the forefinger's metacarpophalangeal joint segment. Those using the interlocking grip, for example, would find this grip enhanced location especially useful when trying to maintain golf club control along the forefinger's metacarpophalangeal joint, the area just below where the weak hand's forefinger interlocks with the dominant hand's pinkie finger.

The coatings could of course also be applied to any selected portions of the glove.

The grip enhancing surface may provide a more effective coefficient of friction than the surrounding areas.

The locations of the grip enhancing means may vary on several factors of course, such as personal preference and preferred degree of enhanced grip. This added grip configuration will be useful especially to those playing the sport of Golf for reasons described herein. Other grip enhancing configurations and locations may of course be preferred.

In the illustrated embodiment, a grip enhancing means is comprised of high friction surfaces areas formed on the glove 80. Specifically, a grip enhancing means is provided on the palmar surface 215 of the pinkie segment 96; a grip enhancing means is also provided on the palmar surface of the forefinger segment 100; a grip enhancing means is also provided on the side surface of the forefinger's proximal phalanx 209 adjacent the middle finger segment; a grip enhancing means is also provided on the side surface of the forefinger's proximal and middle phalanges 213 adjacent the thumb segment; a grip enhancing means is also provided on the dorsal surface of the forefinger segment 99, and; a grip enhancing means is also provided on the side surface of the thumb segment 212, defining all of their respective boundaries.

These surface areas may include a depression or projection pattern formed from a high friction material, or any other form or structure aforementioned. Formed on the illustrated material is a plurality of oval-like depression 209, 210, 211, 212,213 and 215, that are applied to select areas of the embodiment by any standard means, as aforementioned, defining the respective boundaries. These oval-like depressions preferably are spaced apart to allow for added grip and flexibility.

In the illustrated embodiment, a grip enhancing means is also located on the dorsal segment of the forefinger's proximal phalanx 99. Specifically, this finger portion has an insert 214. The insert is positioned midway along the dorsal segment of its proximal phalanx and does not extend beyond the proximal phalanx, thereby defining the boundaries of the insert. Other embodiments can of course offer a similar insert along the same general area but extending to include the forefinger's metacarpophalangeal joint of course.

The insert is preferably of a material having grip-enhancing characteristic or properties formed on it, so as to provide the embodiment with a higher co-efficient of friction than the replaced glove material.

The insert is secured by any standard methods, such as, for example, by replacing the selective glove material in the area defined by sewing (as shown on the edges of the rectangular insert) or similar affixing techniques common to glove construction.

Formed on the insert are non-linear lines, or depressions, creating the grip enhancing characteristics of the embodiment's insert.

Preferably, the depths of the embodiment's grip enhancing means are such that the gap formed by the depressions allow for some movement of the affected surfaces thereby increasing the grip capabilities of the user. The depth can generally begin at about one hundred micrometers to several millimeters or more. For example, these depressions are about two hundred micrometers in depth, about two millimeters in width and four millimeters in length.

Having a gripping enhancing means along these areas will significantly increase a user's ability to control an object such as a golf club by creating an even higher coefficient of friction.

The embodiment's grip enhancing means can also comprise of other high friction configurations of course, such as creating crisscross projections, to the glove area beginning at the digital creases and extending to overlay the forefinger metacarpophalangeal joint, the middle finger metacarpophalangeal joint, the ring finger metacarpophalangeal joint, and the pinkie finger metacarpophalangeal joint. The height of the projections may vary, as aforementioned. These projections can start at about ½ millimeter in height, for example.

A plurality of micro recesses of about 0.120 millimeters or so in diameter may be randomly disposed about the front, back and finger and thumb stalls of the glove, thereby providing added comfort and more ventilation. The illustrated embodiment provides micro-recesses throughout the thumb 137 as well as the pinkie finger 108 and ring finger digital segments 109. Additionally, no micro-recesses are provided on the embodiment's middle finger segment but may be provided along said segment's middle or distal phalanx portions, if preferred. An aperture is provided along the middle finger metacarpophalangeal joint segment 110 to allow moisture to escape the middle finger segment without disturbing the interlocked finger area.

The embodiment is suitably a substantially conventionally constructed golf glove, modified as aforementioned. This particular glove can be made of a synthetic leather latex coated glove 80 for added durability. Other materials that could comprise these glove embodiments include, but are not limited to woven materials that include natural, synthetic or blends of natural and synthetic yarns, thermoextruded or thermoset rubbery embodiments including those made from thermoplastic elastomers, cloths or cabretta leather. Examples of synthetic yarns include nylon, polyester, and spandex (polyurethane) yarns.

Additionally, embodiments such as this one, may be coated with a with a water repellant substance, such as a synthetic resin throughout the entire outer surface of the glove.

As aforementioned, the present invention, including this embodiment may be constructed using standard materials and methods of construction known in the art of making sports gloves. For example, construction of this embodiment may be accomplished by standard methods, such as, by designing the dorsal and palmar sections to meet along a conjoining lateral edge to define a pocket for receiving the eminence of a user's hand. Said dorsal and palmar sections could be conjoined by sewing, for example. One could use any standard method of manufacture and assembly or construction.

Additionally, embodiments may offer a liner is fixed to the interior of the glove using methods known in the art, such as stitching. The liner 117 may be integrally formed on the glove. For example, the liner (or sleeve) could be attached to the glove by standard methods, such as by conventional stitching about the perimeter of the dorsal segment, the palmar segment or both.

The lining material (or sleeve) may be comprised of standard lining materials, such as a smooth, flexible knitted fabric. The liner may also comprise of flexible and elastomeric material such as spandex or LYCRA. Other possible materials include a knit of polyester or simply the same material forming the glove. A soft cellular plastic could also be preferred. Additionally, the liner may provide added features to offer warmth and comfort such as by comprising of a fleece material, for example, especially useful when competing in harsher conditions or during extended practices on the golf range, for example.

It will be apparent to one of ordinary skill in the art that many other implementations of liners are possible.

FIG. 8 shows an alternative dorsal segment to FIG. 3. Embodiments may also preferably comprise an aperture 120 along the middle finger segment, such as on any or all of the middle finger's proximal phalanx. This embodiment shows an aperture that resides only on the middle finger's proximal phalanx, large enough such that the skin of the middle finger may touch or be touched by the pinkie finger of the dominant hand, for example, while gripping a golf club. As shown, the aperture resides primarily on the dorsal portion extending to the side of said middle finger segment.

In addition, the embodiment also has an expandable opening means 121 at a wrist end 122 adapted to receive the user's hand. The expandable opening means comprises a strap means 123 at the open end of the glove body for fastening the glove body secure about the wrist area. The strap means may be unitary with the glove body and may include VELCRO fasteners 124, 125, buttons, and the like or other suitable closure means thereon. The strap may have two pads of cohesive-adhesive material for releasably securing the strap, for example. The strap as well as the wrist portion may be sewn onto the glove.

This embodiment also comprises a detachable ball marker 126. A ball marker is often used when playing golf. During certain times, such as when reaching the green or when obstructing another player's direct path to the golf hole, the golfer may pick his ball and place a ball marker directly behind the golf ball; the golfer can then pick up the golf ball. The embodiment provides a convenient, detachable ball marker on the glove. The detachable ball marker in this embodiment is a small circular object 126. The detachable ball marker is secured by any standard fastening means, such as by snap fastening 127, by a VELCRO fastening compartment, or by magnetism.

The embodiment also provides micro recesses along the portion of the thumb stall 128, the ring finger segment 130 and pinkie finger segment 129, for ventilation, as is standard. However, while offering micro-recesses along the dorsal portions of middle and distal phalanges of the middle finger segment 131 these micro recesses are positioned in a way to direct moisture away from the interlocked fingers; there are no micro recesses along any remaining proximal phalanx segment of the middle finger 132.

The materials forming the illustrated embodiment may comprise those discussed in reference to the present invention. Likewise, any previously discussed methods of construction may be applied to this embodiment. The dorsal segment of the embodiment is of the same materials as that forming the palmar segment of FIG. 3.

This dorsal segment may be constructed in the same manner as standard golf gloves, made primarily of a durable but flexible material, such as synthetic leather, while providing a much more elastic fiber such as spandex 133, along the metacarpophalangeal joints of the four fingers. More broadly the material 133 could also comprise a mesh knit polyester fabric insert across this area. Weft rib knit fabrics are porous so benefit of greater movement and they assist in eliminating moisture. The elastic fiber may be inserted in any standard manner and as aforementioned, such as cutting out the dorsal segment of the selected synthetic leather area and replacing the area with the spandex by sewing.

This embodiment further shows how the present invention may comprise a grip enhancing means on the palmar or the dorsal segments, and provide a higher coefficient of friction than the surrounding areas of the grip enhancing means.

In the illustrated embodiment, a grip enhancing means also comprises high friction surface formed on the glove, including the dorsal surface area of the region between the forefinger segment and the middle finger segment 216, formed by a plurality of triangle-like projections. This grip enhancing means is bounded by the region around the forefinger and middle finger's metacarpophalangeal joints. This grip enhancing means is primarily between these two metacarpophalangeal joints, and does not extend beyond the tip of these two joints in any direction, defining its general boundaries.

These surface areas may include a depression or projection pattern formed from the high friction material, or any other form or structure aforementioned. Formed on the illustrated material is a plurality of triangle-like projections 216, that are applied to select areas of the embodiment by any standard means, as aforementioned. These triangle-like projections preferably are spaced apart to allow for added grip and flexibility.

As discussed, the aperture along the middle finger segment offers maximum retention of tactile sensation thereby allowing the user to maximize hand coordination, for example, a significant benefit in completing a successful golf swing. Finally and critically important is the added grip provided by the grip enhancing means to support the strong hand's pinkie finger grip as it is placed on top of the gloved weak hand.

This unique offering will significantly increase the golfer's ability to control a golf club and also therefore a golf swing and golf ball.

FIG. 9 shows an alternative dorsal segment to FIG. 6. Embodiments may also preferably comprise an aperture 140 along the middle finger, such as on any or all of middle finger's proximal phalanx. This embodiment shows an aperture that resides only on the middle finger's proximal phalanx, thereby defining its terminal edges, but is large enough such that the skin of the middle finger may touch or be touched by the pinkie finger of the dominant hand, for example, while gripping a golf club. As shown, the aperture resides on the dorsal portion of said middle finger proximal phalanx segment leaving uncovered about seventy percent of said dorsal proximal phalanx.

In general, as aforementioned, a grip enhancing means may be either formed on, insert into, or applied to any selected portion for the glove, such as the palm or any thumb or any existing finger stalls, using any standard methods.

This embodiment shows a gripping means comprising of a high friction surface, such as diamond-shaped 218 and heart-shaped 220 that are projections on a nitrile surface panel 219, for example, then attaching said panel onto a portion of the gloves dorsal surface area. These projections may be in the form of PVC projections or may be of the same material as the panel itself and stamped on, for example or by any standard method. The bottom portion of the panel is attached to the dorsal surface of the glove by any standard methods of attachment, such as by an adhesive or stitching 219. The panel of this embodiment is placed on the dorsal portion of the forefinger's proximal phalanx segment, extending up to but not including the forefinger's metacarpophalangeal joint. The heart-shaped projections 220 also form a pattern in the form of a heart 221.

The strong hand's pinkie finger requires a unique blend of grip and sensitivity capabilities. Providing added grip capabilities along the forefinger's dorsal segment allows a user to better maintain control; providing an aperture along the dorsal segment's proximal phalanx of the middle finger would simultaneously allow the user to maintain tactile sensitivities whereby at least a portion of the middle finger's skin would touch the strong hand.

The materials forming the illustrated embodiments may comprise those discussed in reference to the present invention. Likewise, any previously discussed methods of construction may be applied to this and other embodiments. For example, although the palmar segment of this particular glove is made of a synthetic leather latex coated glove for added durability, the material forming the dorsal segment 222 is of a more elastic material, such as any aforementioned.

FIG. 10 is a drawing of a typical interlocking grip using a prior art glove. As can be seen, the dominant hand's pinkie finger interlocks with the user's weak hand forefinger. The golfer is using a conventional golf glove on the weak hand. One can clearly see that the conventional glove has microrecesses along the middle finger segment's proximal phalanx 223, which of course channels moisture to the interlocked fingers creating an unstable grip.

FIG. 11 shows an alternative dorsal segment to FIG. 1. Embodiments may also or alternatively comprise of a grip enhancing means on the dorsal portion of the middle finger segment, in addition to the grip enhancing means on the forefinger segment.

In the illustrated embodiment, the grip enhancing means comprises high friction surface 224 formed on the middle finger's dorsal segment. Specifically, the grip enhancing means overlays its proximal interphalangeal joint and extends to cover about fifty percent of its proximal phalanx as well as about twenty percent of its middle phalanx, defining the boundaries of the grip enhancing means on the middle finger's dorsal segment.

A grip enhancing means is also formed on the forefinger's dorsal segment. Specifically, a grip enhancing means 225 overlays its proximal interphalangeal joint and extends to cover about fifty percent of its proximal phalanx as well as about twenty percent of its middle phalanx, defining the boundaries of the grip enhancing means on the forefinger's dorsal segment.

The added grip enhancing means along the middle finger and forefinger provide users with a better ability to perform a more unified golf swing, especially for those using the overlapping grip method.

Preferably, the high friction surface is formed from a PVC material, a nitrile material, a latex material, or a rubber material, but may certainly be formed of the same material forming the glove's dorsal segment. The surface may include a depression or projection pattern formed from the high friction material. Formed on the illustrated material is a plurality of square-like projections 224, 225 that are applied to the select area of the dorsal surface by any standard means, as aforementioned, defining the respective boundaries. These square-like projections preferably are spaced apart to allow for added grip and flexibility.

Preferably, the heights of the embodiment's projections are such that the gap formed by the projections allow for some movement of the affected surfaces thereby increasing the grip capabilities of the user. The height can generally begin at about two hundred micrometers to several millimeters or more. For example, these projections are about three hundred micrometers in height, about one millimeter in width and three millimeters in length.

The dorsal segment may be made of the same or different material than the palmar segment. This dorsal segment is made of a nylon mesh material 227, which would be conjoined with the cabretta leather palmar segment, as illustrated in FIG. 1, thus creating the glove. One benefit of configuring the forefinger's dorsal segment of this type of material is that, in addition to offering added flexibility and grip, there should less accumulation of moisture inside the forefinger segment which, of course will make it easier to provide a dry forefinger dorsal segment—where the strong hand's pinkie finger overlays the weak hand when using the overlapping grip method). In addition, the dorsal segment of the glove may be made of wicking fabrics.

The dorsal segment can of course be of similar material as the palmar segment. If the dorsal surface is comprised of more durable fabrics, such as synthetic leather, then some added elasticity capabilities may be also preferable, though not required, on select area of the dorsal surface, in particular around the metacarpophalangeal joints. For example, the dorsal surface may comprise of an aperture on the forefinger's metacarpophalangeal joint, the middle finger's metacarpophalangeal joint, the ring finger's metacarpophalangeal joint, and on the pinkie finger's metacarpophalangeal joint. Alternatively, embodiments may simply comprise of a more elastic material, such as any of those aforementioned such as spandex, on the dorsal surface overlaying said metacarpophalangeal joints, or seams or slits, while the rest of the dorsal surface is comprised of a more durable material. The elastic material could be stitched onto those areas, and therefore replacing the more durable materials along those select areas.

The palmar and dorsal surfaces, and any wrist portions, may then be conjoined on any finger and thumb portions, dorsal and palm portions and a wrist portion using any standard methods, such as by stitching, thus defining a pocket for receiving a user's hand.

As aforementioned, this embodiment provides users with several benefits, in multiple sports. For example, those playing the sport of Golf may use this embodiment on their weak hand thereby allowing the golfer significantly more grip capabilities, in particular for those gripping a golf club using the overlapping grip method. As discussed, there are minor variations when using the overlapping grip method. One variation includes placing the strong hand's ungloved pinkie finger and placing it on top of the weak hand's gloved forefinger and middle finger. This embodiment thus provides golfers using this variation of the overlapping grip with a more sustainable unified golf grip.

FIG. 12 shows another alternative dorsal segment to FIG. 3.

Embodiments may also or alternatively comprise of a grip enhancing means on the side portion of the forefinger segment, in addition to the grip enhancing means on the middle finger segment.

In the illustrated embodiment, the grip enhancing means comprises high friction surface formed on the side portion of the forefinger segment, adjacent the middle finger segment. Specifically, the grip enhancing means overlays its proximal interphalangeal joint and extends to cover about sixty percent of its proximal phalanx as well as about fifty percent of its middle phalanx, defining the boundaries of the grip enhancing means 228 on the side portion of the forefinger segment.

A grip enhancing means is also formed on the side portion of the middle finger segment, adjacent the forefinger segment. Specifically, a grip enhancing means also overlays its proximal interphalangeal joint and extends to cover about fifty percent of its proximal phalanx as well as about twenty percent of its middle phalanx, defining the boundaries of the grip enhancing means 229 on the side portion of the middle finger segment.

The added grip enhancing means along the middle finger and forefinger segments provide users with a better ability to complete a more unified golf swing, especially for those using the overlapping grip method.

The grip enhancing means are all in the form of PVC dots 59, 228, 229. The PVC dots preferably project out at least about six hundred micrometers. This will allow for greater golf club grip retention especially throughout the down swing of a golf swing when some separation between the hands takes place.

Providing the grip enhancing means on the dorsal portion and select side portions allow the ungloved pinkie finger to overlap or interlock and better grip the gloved weak hand, a major and necessary improvement.

The palmar segment, as described in FIG. 3, might require a minor alteration, preferably eliminating the grip enhancing means along the area between the forefinger and middle finger segment 203.

The grip enhancing means of the present invention may be integral to the glove or may be affixed to the glove using any standard methods. For example, this embodiment comprises grip enhancing means that is integral to the glove, using any standard method known in the art. For example, the PVC dots can be imparted by any standard methods, such as, for example, by molding. The heights of the PVC dots in this embodiment are all the same height, and are generally in rows. Other embodiments could of course offer different heights, non-uniform heights, and have a more random pattern on the top surface.

A plurality of micro recesses of about 0.120 millimeters in diameter may be randomly disposed about the front, back and finger and thumb stalls of the glove, thereby providing added comfort and more ventilation. The illustrated embodiment has micro recesses along and throughout the pinkie finger segment 63 and ring finger segment 64.

Additionally, there are micro recesses along the distal 65 and middle phalanges 66 of the middle finger segment. An important aspect of this embodiment is that there are micro recesses only along the side of the proximal phalanx of the middle finger 205, adjacent the ring finger. When a user of this embodiment grips a golf club using the overlapping grip method for example, the strong hand's ungloved pinkie finger is often placed between the gloved weak hand's forefinger and middle finger segment—the location where the embodiment provides grip enhancing surfaces—thereby providing a more sustainable grip between the overlapping fingers.

As can be seen in FIG. 17, the strong hand's pinkie finger often comes into contact with the weak hand's middle finger segment 303. Providing micro-recesses along the middle finger's proximal phalanx should direct moisture away from the overlapped fingers. For the same reasons, the micro-recesses along the forefinger segment are also strategically placed to minimize moisture around the overlapped fingers (or interlocked fingers). Shown, only the distal phalanx of the forefinger provides micro-recesses 230. Therefore, this embodiment also solves an unrecognized configuration problem with prior art.

The dorsal surface is preferably of similar material as the palmar segment 41. It may, of course comprise of a different material than the palmar surface, such as a more durable fabric, but would preferably also be rather flexible. If the dorsal surface is comprised of more durable fabrics, such as synthetic leather, then some added elasticity capabilities may be also preferable, though not required, on select area of the dorsal surface, in particular around the metacarpophalangeal joints.

The palmar and dorsal surfaces, and any wrist portions, may then be conjoined on any finger and thumb portions, dorsal and palm portions and a wrist portion using any standard methods, such as by stitching, thus defining a pocket for receiving a user's hand.

As aforementioned, this embodiment provides users with several benefits, in multiple sports. For example, those playing the sport of Golf may use this embodiment on their weak hand thereby allowing the golfer significantly more grip capabilities, in particular for those use grip a golf club using the overlapping grip method. As discussed, there are minor variations when using the overlapping grip method. One variation includes placing the strong hand's ungloved pinkie finger and placing it in between the weak hand's gloved forefinger and middle finger. This embodiment thus provides golfer's using this variation of the overlapping grip with a more sustainable, unified golf grip.

FIG. 13 shows another alternative dorsal segment to FIG. 6.

Embodiments may also or alternatively comprise of a grip enhancing means on the dorsal portion of the middle finger segment, in addition to the grip enhancing means on the forefinger segment.

In the illustrated embodiment, the grip enhancing means comprises high friction surface formed on the middle finger's dorsal segment. Specifically, the grip enhancing means overlays its proximal phalanx and extends to overlay a portion of the proximal interphalangeal joint, defining the boundaries of the grip enhancing means 231 on the middle finger's dorsal segment.

A grip enhancing means also comprises high friction surfaces formed on other locations of the glove 80, including on the palmar surface 215 of the pinkie segment 96, on the palmar surface of the forefinger segment 100, on the side surface of the forefinger's proximal phalanx 209 adjacent the middle finger segment, on the side surface of the forefinger's proximal and middle phalanges 213 adjacent the thumb segment, on the dorsal surface of the forefinger segment 233, and on the side surface of the thumb segment 212, defining all of their respective boundaries.

These surface areas may include a depression or projection pattern formed from a high friction material, or any other form or structure aforementioned. Formed on the illustrated material is a plurality of oval-like depression 209, 210, 211, 212, 213, 215 and 231, that are applied to select areas of the embodiment by any standard means, as aforementioned, defining the respective boundaries. These oval-like depressions preferably are spaced apart to allow for added grip and flexibility.

In the illustrated embodiment, a grip enhancing means is also located on the dorsal segment of the forefinger's proximal phalanx 99. Specifically, this finger portion has an insert 233. The insert is positioned midway along the dorsal segment of its proximal phalanx and extending to include the forefinger's metacarpophalangeal joint.

The insert provides the embodiment with a higher coefficient of friction than the replaced glove material.

The insert is secured by any standard methods, such as, for example, by replacing the selective glove material in the area defined by sewing (as shown on the edges of the rectangular insert) or similar affixing techniques common to glove construction.

Formed on the insert are non-linear lines, or depressions, creating the grip enhancing characteristics of the embodiment's insert. Preferably, the depths of the embodiment's grip enhancing means are such that the gap formed by the depressions allow for some movement of the affected surfaces thereby increasing the grip capabilities of the user. The depth can generally begin at about one hundred micrometers to several millimeters or more. For example, these depressions are about two hundred micrometers in depth, about two millimeters in width and four millimeters in length.

Having a gripping enhancing means along these areas will significantly increase a user's ability to control an object such as a golf club by creating an even higher coefficient of friction along critical areas of the golf glove.

The added grip enhancing means along the middle finger and forefinger provide users with a better ability to perform a more unified golf swing, especially for those using the overlapping grip method.

For example, one variation of the overlapping grip method is to place the strong hand's pinkie finger more directly over the weak hand's middle finger segment—exactly where the inserted grip enhancing means is located 233.

The embodiment provides an additional opportunity to complete a more unified golf swing in the form of a grip enhancing means along the side of the forefinger segment 213, adjacent the thumb segment; the area that generally touches the strong hand's ring finger.

A plurality of micro recesses of about 0.120 millimeters in diameter may be randomly disposed about the front, back and finger and thumb stalls of the glove, thereby providing added comfort and more ventilation. The illustrated embodiment provides micro-recesses throughout the thumb 137 as well as the pinkie finger 108 and ring finger digital segments 109.

Additionally, no micro-recesses are provided on the embodiment's middle finger segment but may be provided along said segment's middle or distal phalanx portions, if preferred.

An aperture is provided along the middle finger and forefinger's metacarpophalangeal joint segment 110, 304 to allow moisture to escape without disturbing the area where the fingers overlap.

Providing a more strategic moisture management system will disperse moisture away from the overlapped fingers, for example, and thereby allowing a user to have a better overall grip between the user's hands.

The embodiment is suitably a substantially conventionally constructed golf glove, modified as aforementioned. This dorsal segment 305 is made of the same material generally used to form the palmar segment of the glove 80.

Additionally, embodiments such as this one, may be coated with a with a water repellant substance, such as a synthetic resin throughout the entire dorsal segment of the forefinger 99 and middle finger 91.

As aforementioned, the present invention, including this embodiment may be constructed using standard materials and methods of construction known in the art of making sports gloves. For example, construction of this embodiment may be accomplished by standard methods, such as, by designing the dorsal and palmar sections to meet along a conjoining lateral edge to define a pocket for receiving the eminence of a user's hand. Said dorsal and palmar sections could be conjoined by sewing, for example. One could use any standard method of manufacture and assembly or construction.

This embodiment provides users with several benefits, in multiple sports. For example, those playing the sport of golf may use this embodiment on their weak hand thereby allowing the golfer significantly more grip capabilities for those who grip a golf club using either the interlocking or overlapping grip methods. As discussed, this embodiment thus provides golfer's with a more sustainable unified golf grip.

Now referring to FIG. 14 and FIG. 15, another glove embodiment of the present invention is shown and designated as 240. The palmar (front) view of a left-handed glove is drawn in FIG. 14 and the dorsal (back) view of the same glove is drawn in FIG. 15. This embodiment provides a glove having a dorsal portion 241, a palmar portion 242 for overlaying respective back and palm regions of a human hand, said dorsal and palmar portions having distal and proximal ends with a plurality of digital segments (or stalls) projecting from said distal ends. The glove includes a glove body having a back portion covering the back of the hand 241, and a front portion covering the palm or front of the hand 242. The glove body includes finger stalls and a thumb stall each adapted to receive a finger or thumb, respectively, therein.

In the illustrated embodiment, the glove is constructed such that the thumb segment 243, forefinger segment 244, middle finger segment 245, ring finger segment 246 and pinkie digital segment 247 enclose said thumb, forefinger, middle finger, ring finger, and pinkie fingers including enclosing the fingertips, respectively.

The palmar section covers the entire palm of the hand 242 and the dorsal section covers the back of the hand 241. The glove also has a wrist portion that surrounds the wrist of a user.

The thumb stall 243 is defined by a dorsal portion 248 and a palmar portion 249. The forefinger stall 244 is defined by a dorsal portion 250 and a palmar portion 251. The middle finger stall 245 is defined by a dorsal portion 252 and a palmar portion 253. The ring finger stall 246 is defined by a dorsal portion 254 and a palmar portion 255. The pinkie finger stall 247 is defined by a dorsal portion 256 and a palmar portion 257.

The wrist portion is preferably expansible so as to hold more securely to the user's wrist. Therefore the embodiment also has an expandable opening means at a wrist end 260 adapted to receive the user's hand. The expandable opening means comprises an elastic material along the wrist portion, such as an elastomeric band 261 fixed around throughout the wrist. In addition, the opening means comprises a strap means 262 at the open end of the glove body for fastening the glove body secure about the wrist area. The strap means may be unitary with the glove body and may include VELCRO fasteners 263, 264, buttons, and the like or other suitable closure means thereon.

This embodiment further shows how the present invention may comprise a grip enhancing means on select portions of the glove, and thus providing a higher coefficient of friction than the surrounding areas of the grip enhancing means.

The grip enhancing means can comprise of a high friction surface by applying a non-slip coating, such as a latex, a nitrile or PVC coating, along described locations of this embodiment, such as on the forefinger's metacarpophalangeal joint segment. Those using the overlapping grip method, for example, would find this grip enhanced location useful when trying to maintain golf club control along the forefinger's metacarpophalangeal joint area where, coupled with the weak hand's thumb, provide much of the force and control when the golfer unhinges his wrists during the downswing of a proper golf swing.

The coatings could of course also be applied to any selected portions of providing a grip enhancing means on the glove.

The grip enhancing surface would provide a more effective coefficient of friction than the surrounding surface areas of the glove.

The locations of the grip enhancing means may vary on several factors of course, such as personal preference and preferred degree of enhanced grip. This added grip configuration will be useful especially to those playing the sport of Golf for reasons described herein. Other grip enhancing configurations and locations may of course be preferred.

In the illustrated embodiment, a grip enhancing means 280 is located on the palmar surface of the pinkie segment 257; a grip enhancing means 281 is also provided throughout the entire palmar surface of the forefinger segment 251; a grip enhancing means 265, 266 is also provided throughout both side surface areas of the forefinger portions; a grip enhancing means 271 is also provided throughout the entire dorsal surface of the forefinger segment; a grip enhancing means 269 is also provided on the entire palmar surface of the thumb segment, and; a grip enhancing means is also provided along the proximal phalanx of the middle finger's dorsal portion 268, defining all of their respective boundaries.

These surface areas may include a depression or projection pattern formed from a high friction material, or any other form or structure aforementioned. Formed on the illustrated embodiment is a plurality of oval-like depressions 280, 281, 265, 266, 271 that are applied to select areas of the embodiment by any standard means, as aforementioned, defining the respective boundaries. These oval-like depressions preferably are spaced apart to allow for added grip and flexibility. Thus, this embodiment comprises a grip enhancing means throughout the entire forefinger segment of the embodiment 244.

Preferably, the depths of the embodiment's grip enhancing means are such that the gap formed by the depressions allow for some movement of the affected surfaces thereby increasing the grip capabilities of the user. The depth can generally begin at about one hundred micrometers to several millimeters or more. For example, these depressions are about two hundred micrometers in depth, about two millimeters in width and four millimeters in length.

In the illustrated embodiment, a grip enhancing means is also located on the dorsal segment of the middle finger's proximal phalanx 268. Specifically, the grip enhancing means provided is a coating, such as PVC 268 or nitrile. The coating is applied along the dorsal segment of its proximal phalanx and does not extend beyond the proximal interphalangeal joint, thereby defining the boundaries of the grip enhancing means (the coated portion).

Having a grip enhancing means along these areas will significantly increase a user's ability to control an object such as a golf club by creating an even higher coefficient of friction along key grip areas for a golfer.

The embodiment's grip enhancing means can also comprise of other high friction configurations of course, such as creating crisscross projections, to the glove area beginning at the digital creases and extending to overlay the forefinger metacarpophalangeal joint, the middle finger metacarpophalangeal joint, the ring finger metacarpophalangeal joint, and the pinkie finger metacarpophalangeal joint. The height of the projections may vary, as aforementioned. These projections can start at about ¼ millimeter in height, for example.

In the illustrated embodiment, a grip enhancing means is also located on the entire palmar portion of the thumb segment 269. Specifically, the grip enhancing means provided is a tackified leather coating 269. Tackified material provides very high grip capabilities. Properly gripping a golf club using the overlapping method requires that the thumb run parallel or nearly parallel to the shaft of the golf club. As the golfer begins the downswing the thumb segment may have challenges in maintaining consistent grip and pressure without slipping. Providing the tackified leather especially along the thumb's distal phalanx will allow the golfer to maintain 'a neat and parallel' weak hand thumb throughout the golf swing. The grip enhancing means may be applied by any suitable methods, such as tackifying the leather segment and then sewing the tackified leather on to the thumb segment's dorsal segment along the edges to create a thumb stall.

Having a gripping enhancing means along these areas will significantly increase a user's ability to control an object such as a golf club by creating an even higher coefficient of friction.

The embodiment is suitably a substantially conventionally constructed golf glove, modified as aforementioned. This particular glove can generally be made of cabretta leather 240 or similar material for added durability, or flexibility. Other materials that could comprise these glove embodiments include, but are not limited to woven materials that include natural, synthetic or blends of natural and synthetic yarns, thermoextruded or thermoset rubbery embodiments including those made from thermoplastic elastomers, cloths, synthetic leather, recycled materials, or other materials aforementioned. Examples of synthetic yarns include nylon, polyester, and polyurethane yarns. Additionally, embodiments such as this one, may be coated with a with a water repellant substance, such as a synthetic resin throughout the entire surface of the glove.

This dorsal segment may be constructed in the same manner as standard golf gloves, made of a durable and flexible material, such as synthetic leather, while providing a much more elastic fiber such as spandex 310, along the metacarpophalangeal joints of the four fingers. More broadly the material 310 could also comprise a mesh knit polyester fabric insert across this area. Weft rib knit fabrics are porous so benefit of greater movement and they assist in eliminating moisture. The elastic fiber may be inserted in any standard manner and as aforementioned, such as cutting out the dorsal segment of the selected synthetic leather area and replacing the area with the spandex by sewing.

As aforementioned, the present invention, including this embodiment may be constructed using standard materials and methods of construction known in the art of making sports gloves. For example, construction of this embodiment may be accomplished by standard methods, such as, by designing the dorsal and palmar sections to meet along a conjoining lateral edge to define a pocket for receiving the eminence of a user's hand. Said dorsal and palmar sections could be conjoined by sewing, for example. One could use any standard method of manufacture and assembly or construction.

Additionally, embodiments may offer a liner is fixed to the interior of the glove using methods known in the art, such as stitching. The liner 276 may be integrally formed on the glove. For example, the liner could be attached to the glove by standard methods, such as by conventional stitching about the perimeter of the dorsal segment, the palmar segment or both.

The lining material may be comprised of standard lining materials, such as a smooth, flexible knitted fabric. The liner may also comprise of flexible and elastomeric material such as spandex or LYCRA. Other possible materials include a knit of polyester or simply the same material forming the glove. A soft cellular plastic could also be preferred. Additionally, the liner may provide added features to offer warmth and comfort such as by comprising of a fleece material, for example, especially useful when competing in harsher conditions or during extended practices on the golf range, for example.

A plurality of micro recesses of about 0.120 millimeters or so in diameter may be randomly disposed about the front, back and finger and thumb stalls of the glove, thereby providing added comfort and more ventilation. The illustrated embodiment provides micro-recesses throughout the thumb 277 as well as the pinkie finger 278 and ring finger digital segments 279. Additionally, micro-recesses can be provided along the metacarpophalgeal joints of the middle finger and forefinger segments 274, along the more elastic segment, if preferred, to direct any moisture away from the overlapped fingers.

It will be apparent to one of ordinary skill in the art that many other implementations are possible.

FIG. 16 is a drawing of a typical overlapping grip method using prior art. As can be seen, the dominant hand's pinkie finger overlays with the user's weak hand. The golfer is using a conventional golf glove on the weak hand. One can clearly see that the conventional glove has micro-recesses along the middle finger segment's proximal phalanx 303 as well as along the forefinger segment's proximal phalanx, which of course channels moisture to the interlocked fingers creating an unstable grip.

I claim:

1. A sports glove, said glove having dorsal and palmar portions adapted to overlay a back and palm of a wearer's hand respectively, wherein said dorsal and palmar portions have distal and proximal ends with a plurality of digital segments projecting from the distal end, wherein said glove provides a thumb digital segment that is adapted to enclose the entire thumb of the wearer and has a dorsal and palmar sides, wherein said glove provides a forefinger digital segment that is adapted to enclose the entire forefinger of the wearer and has a dorsal and palmar sides, wherein said glove provides a middle finger digital segment that is adapted to enclose the entire middle finger of the wearer and has a dorsal and palmar sides, wherein said glove provides a ring finger digital segment that is adapted to enclose the entire ring finger of the wearer and has a dorsal and palmar sides, wherein said glove provides a pinkie finger digital segment that is adapted to enclose the entire pinkie finger of the wearer and has a dorsal and palmar sides; and wherein said glove further comprises a high friction textured exterior surface formed of a grip enhancing means on an exterior surface of the dorsal side of said middle finger digital segment and forefinger digital segment, and wherein the thumb segment dorsal side, the forefinger dorsal side, and the pinkie finger dorsal side are completely free of said grip enhancing means; and wherein an entire exterior surface of said glove dorsal portion is completely free of said grip enhancing means;

wherein said textured surface of said dorsal side provides a higher coefficient of friction than an un-textured dorsal portion.

2. The glove as claimed in claim 1, further comprising an expandable opening means at a wrist end adapted to receive the user's hand.

3. The glove as claimed in claim 1, wherein said grip enhancing means consists of a plurality of depressions.

4. The glove, as claimed in claim 1, wherein said grip enhancing means comprises of a plurality of projections.

5. The glove, as claimed in claim 1, further comprising micro recesses or an aperture along the side portion of the forefinger segment, adjacent the thumb segment; whereby moisture build up from said middle finger will be directed away from the interlocked said forefinger, and a user's strong hand's pinkie finger.

6. The glove as claimed in claim 1, further comprising a grip enhancing means consists of a plurality of projections;

wherein said plurality of projections have a height, or project out, such that the gap formed by said projections allow for some movement of said projections, thereby increasing the grip capabilities of a wearer; and wherein said glove body is formed of a wicking material.

7. The glove, as claimed in claim 1, wherein said grip enhancing means is comprised of a PVC coating, a nitrile coating, a neoprene coating, a vinyl coating, or a high friction coating configured to provide a Coefficient of Friction of about 1.5.

* * * * *